US008678044B2

(12) United States Patent
Rabin et al.

(10) Patent No.: US 8,678,044 B2
(45) **Date of Patent: *Mar. 25, 2014**

(54) COTTON TOWEL WITH STRUCTURAL POLYESTER REINFORCEMENT

(71) Applicant: Six Continents Hotels, Inc., Atlanta, GA (US)

(72) Inventors: Sidney Rabin, Miami, FL (US); Glen Paul Phillips, Shoreview, MN (US); Dewey Todd, Kershaw, SC (US)

(73) Assignee: Six Continents Hotels, Inc., Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/939,038

(22) Filed: Jul. 10, 2013

(65) Prior Publication Data

US 2013/0306189 A1 Nov. 21, 2013

Related U.S. Application Data

(60) Continuation of application No. 13/592,229, filed on Aug. 22, 2012, now Pat. No. 8,490,657, which is a division of application No. 12/775,898, filed on May 7, 2010, now Pat. No. 8,267,126.

(60) Provisional application No. 61/176,831, filed on May 8, 2009.

(51) Int. Cl.

| | |
|---|---|
| ***D03D 27/08*** | (2006.01) |
| ***D03D 27/00*** | (2006.01) |
| *D03D 25/00* | (2006.01) |

(52) U.S. Cl.
USPC ..... 139/396; 139/383 R; 139/391; 139/392; 139/416; 139/417

(58) Field of Classification Search
USPC ..... 139/383 R, 391, 392, 396, 416, 417, 139/420 R, 426 R, 420 A
See application file for complete search history.

(56) References Cited

U.S. PATENT DOCUMENTS 3,721,274 A * 3/1973 Sherrill et al. ..... 139/396
4,078,958 A 3/1978 Patin (Continued)

FOREIGN PATENT DOCUMENTS

DE 23 53 404 5/1975
EP 2427594 3/2012

(Continued)

OTHER PUBLICATIONS

"Non-Final Office Action", U.S. Appl. No. 13/592,229, mailed Dec. 3, 2012.

(Continued)

*Primary Examiner* — Bobby Muromoto, Jr.
(74) *Attorney, Agent, or Firm* — Kilpatrick Townsend & Stockton LLP

(57) ABSTRACT

A mostly cotton yarn terry cloth product is provided with borders having high content polyester yarns. The polyester borders are more rugged, and thus aid in preventing fraying and failure along the edges. In addition, reinforcing ribs, also formed from yarns have a high polyester content, may be provided that extend from a border on one side of the terry cloth product to a border on the other side. This feature anchors the borders in place, limiting failure at the juncture of the border and the adjacent cotton.

30 Claims, 2 Drawing Sheets

(56) References Cited

U.S. PATENT DOCUMENTS

| | | | | |
|---|---|---|---|---|
| 4,589,361 | A | 5/1986 | Starnes | |
| 4,726,977 | A | 2/1988 | Goldstein | |
| 4,984,606 | A * | 1/1991 | Moore et al. | 139/25 |
| 5,084,322 | A | 1/1992 | Brioschi | |
| 6,062,272 | A * | 5/2000 | Waite | 139/420 A |
| 6,546,965 | B2 | 4/2003 | Hamby | |
| 6,770,581 | B1 | 8/2004 | DeMott | |
| 7,044,173 | B2 | 5/2006 | Silver | |
| 8,267,126 | B2 * | 9/2012 | Rabin et al. | 139/396 |
| 8,490,657 | B2 * | 7/2013 | Rabin et al. | 139/396 |
| 2001/0044249 | A1 * | 11/2001 | Demott et al. | 442/304 |
| 2003/0046771 | A1 * | 3/2003 | Kimbrell | 8/115.51 |
| 2004/0055659 | A1 * | 3/2004 | Hugh Silver | 139/396 |
| 2004/0185728 | A1 * | 9/2004 | Moore et al. | 442/79 |
| 2004/0224121 | A1 * | 11/2004 | Sheppard, Jr. | 428/92 |
| 2005/0081939 | A1 * | 4/2005 | Heiman | 139/25 |
| 2007/0234970 | A1 | 10/2007 | Farzan | |
| 2007/0276302 | A1 * | 11/2007 | Evans et al. | 602/8 |
| 2008/0038981 | A1 | 2/2008 | Hanes | |
| 2009/0095026 | A1 * | 4/2009 | Araki et al. | 66/187 |
| 2010/0282359 | A1 * | 11/2010 | Rabin et al. | 139/396 |
| 2011/0143083 | A1 * | 6/2011 | Scorgie | 428/95 |

FOREIGN PATENT DOCUMENTS

| | | | |
|---|---|---|---|
| GB | 2 163 996 | A | 3/1986 |
| HK | 1164951 | A | 9/2012 |
| JP | 2007211384 | A | 8/2007 |
| WO | 2010/129857 | A1 | 11/2010 |

OTHER PUBLICATIONS

"Notice of Allowance", U.S. Appl. No. 13/592,229, mailed Mar. 21, 2013.

"Restriction Requirement", U.S. Appl. No. 12/775,898, mailed Feb. 9, 2012.

"Notice of Allowance", U.S. Appl. No. 12/775,898, mailed May 25, 2012.

"International Search Report and Written Opinion", International Application No. PCT/US2010/034017, mailed Sep. 20, 2010.

* cited by examiner

COTTON TOWEL WITH STRUCTURAL POLYESTER REINFORCEMENT

CROSS-REFERENCES TO RELATED APPLICATIONS

The present application is a continuation application of U.S. application Ser. No. 13/592,229, filed on Aug. 22, 2012, now U.S. Pat. No. 8,490,657, which is a divisional application of U.S. application Ser. No. 12/775,898, filed on May 7, 2010, now U.S. Pat. No. 8,267,126, which claims the benefit of U.S. Provisional Application No. 61/176,831, filed on May 8, 2009, the full disclosures of which are incorporated herein by reference.

BACKGROUND

Hospitality terry cloth bathroom items, such as wash cloths, hand towels, bath mats and bath towels, are frequently made of 100% cotton for absorbency and feel. However, cotton terry cloth is inherently weak, which makes the outer edges (selvage and hemmed) prone to pre-mature failure. This failure may be due to poor construction and/or the weak characteristics of the cotton fibers.

Due to the high failure rate of the cotton terry cloth products, using 100% cotton terry cloth items in the hospitality industry creates a budgetary burden that is hard to overcome since damaged or defective towels cannot be placed in a guest room. Continued replacement of terry cloth bathroom items is expensive and wasteful. Many hotels, in order to keep their expenses in check, do not purchase sufficient inventory to service their hotels. As a result, terry items are laundered and rotated at least four times per week. Given the useful life of a terry cloth towel as an example at 50 use and laundering cycles, the calculated life of a towel is 12.5 weeks before the item needs replacing.

There is substantial expense in replacing such towels, especially for the higher quality towels, which typically provide even shorter life span. A premium quality bath towel, normally used to exhibit value to hotel customers, can cost anywhere from around US$5.00 each up to US$7.00 each. The average hotel will normally get between 20 and 25 uses out of such a premium bath towel (the most expensive piece in the bathroom ensemble). More often than not the towel has plenty of life remaining in the body, but its edges fail because of inadequate structural construction in the selvage edges or top and bottom hems. This failure can also occur in the sewn upper and lower hems.

Part of the reason for these failures is the construction technique used by the weaving mills when constructing these products. Spun cotton yarns are used almost exclusively throughout a towel used in the hospitality industry; fine combed and carded cotton, when twisted together, make a quasi-durable component in the towel manufacturing process but a single yarn can be chaffed, and broken through multiple uses. When this happens all of the remaining yarns used in the process are prone to failure as well.

Over the years some manufacturers have blended cotton with polyester in ratios of 86% cotton/14% polyester in an effort to make the terry cloth items stronger and more durable. However, many corporate hotels have resisted buying these types of towels thinking that any terry product that has any polyester in the composition would be less appealing than their 100% cotton counterparts.

BRIEF SUMMARY

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

In an embodiment, a terry cloth product, such as a towel, is provided, including a pile fabric having a width and a length, first and second length edges, a first set of yarns extending lengthwise and forming a first border along the first length edge, and a second border along the second length edge. A second set of yarns extends lengthwise and between the first and second borders and a third set of yarns forms a reinforcing rib extending widthwise between and into the first and second borders. The first, second, and third sets of yarns include cotton, and the second and third sets of yarns comprise a polyester fiber content higher than the first set of yarns.

In an embodiment, the polyester content of the first set of yarns is approximately 0%, and the polyester content of the second and third set of yarns is approximately 50%.

The first and second borders may be, for example, ¾ inch in width. Likewise, the reinforcing rib may be approximately ¾ inch in width. The ribs may be spaced as desired, and in an embodiment are spaced between approximately 3 and 6 inches, on center, apart from one another. Smaller width of ribs may be used when the ribs are placed closer together. In either event, the total polyester content of the towel is preferably maintained at a low amount, such as 3 to 5% of the total towel composition.

The terry cloth product may include a plurality of the reinforcing ribs comprising the set of third yarns, each of the reinforcing ribs extending between the first and second borders and being spaced from the other ribs. Each of the plurality may be formed from weft yarns.

In an embodiment, the first and second borders each have a doubled over hem. The doubled over hems for the first and second borders may be attached by two needle stitching.

The terry cloth product may also include first and second width edges, and a fourth set of yarns extending lengthwise and forming a first width border along the first width edge, and a second width border along the second width edge. The fourth sets of yarns may also include a polyester fiber content higher than the first set of yarns.

In accordance with another embodiment, a terry cloth product is provided having warp yarns, including first and second border warp yarns and middle warp yarns captured between the first and second border warp yarns, with the border warp yarns having a higher polyester content than the middle warp yarns. The product also includes weft yarns, the weft yarns including primary weft yarns, and a reinforcing rib weft yarn set, the reinforcing rib weft yarn set having primary weft yarns on each side; the reinforcing rib weft yarn set comprising yarns having a higher polyester content than the primary weft yarns.

In yet another embodiment, a terry cloth product is provided, having a cotton ground center and a high polyester content, cotton/polyester blend outer border.

In further embodiments, a method of producing a terry cloth product, including weaving a first weft yarn through warp yarns to form a high polyester content, cotton/polyester blend outer border; and weaving a second weft yarn, different from the first weft yarn, to form a cotton ground center for the terry cloth product. The method may include weaving a third weft yarn into the warp yarns, to form a high polyester content, cotton/polyester blend rib for the terry cloth product, the rib, after completion, being captured between two different layers of the second weft yarn.

For a fuller understanding of the nature and advantages of the present invention, reference should be made to the ensuing detailed description and accompanying drawings.

DETAILED DESCRIPTION

In the following description, various embodiments of the present invention will be described. For purposes of explanation, specific configurations and details are set forth in order to provide a thorough understanding of the embodiments. However, it will also be apparent to one skilled in the art that the present invention may be practiced without the specific details. Furthermore, well-known features may be omitted or simplified in order not to obscure the embodiment being described.

Figure 1:
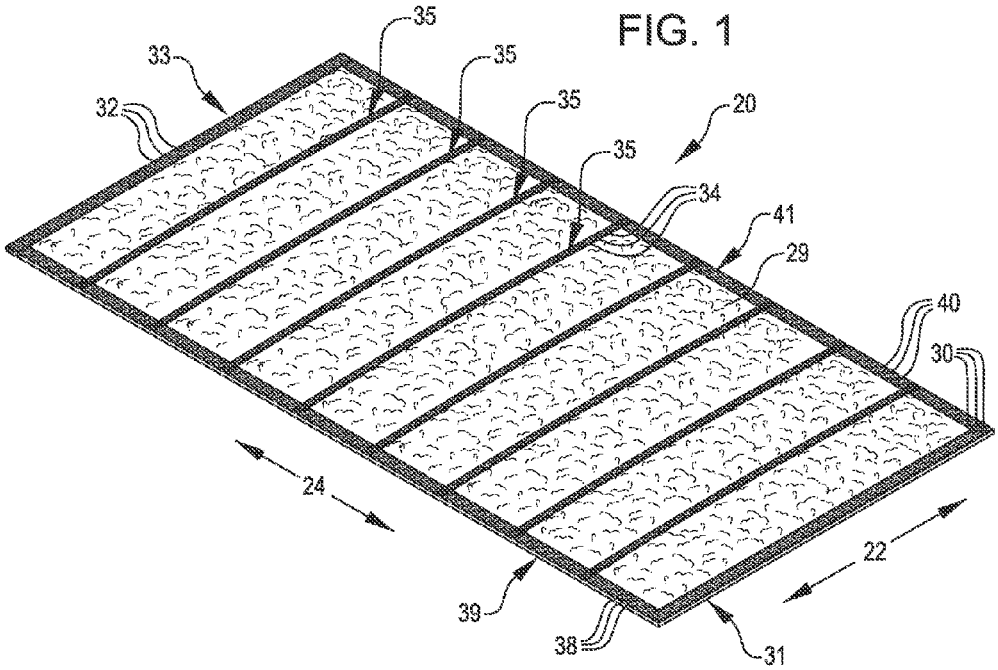
FIG. 1 is an isometric view of a terry cloth product in accordance with an embodiment.
Figure 4:
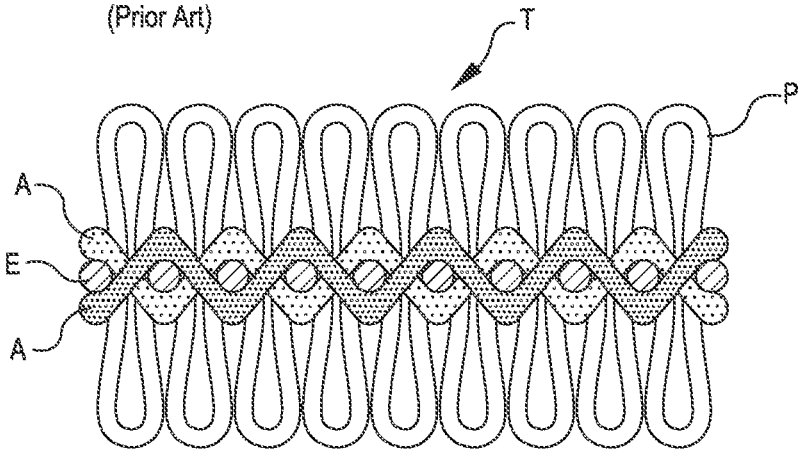
FIG. 4 (Prior Art)
FIG. 4 is a diagrammatic representation of a prior art terry cloth product.

Referring now to the drawings, in which like reference numerals represent like parts throughout the several views, FIG. 1 shows an isometric view of a terry cloth product 20 in accordance with an embodiment. As is known and as is shown in FIG. 4, terry cloth textiles or products T include three different yarn types. Warp yarns A run continuously through the terry cloth product T. Weft or filling yarns E run perpendicular to the warp yarns A, and pile yarns P are interlaced and locked into position by the warp yarns A and weft yarns E with uncut loops on both sides. Terry cloth products T are woven to absorb, wick, and hold liquids.

Returning to FIG. 1, the terry cloth product 20 may be any terry cloth product, but in an embodiment is a hospitality or institutional terry cloth bathroom item, such as a wash cloth, a hand towel, a bath mat, or a bath towel. Embodiments described herein are directed primarily to bath towels, but other products may be produced using variations in geometry and size.

As described in the background section of this disclosure, cotton is the preferred material for a terry cloth bathroom item because of its absorbency characteristics. However, cotton suffers some drawbacks, particularly with outer-edge failure, as described above. In accordance with an embodiment, as described in more detail below, a mostly cotton yarn terry cloth product is provided with borders having high content polyester yarns. The polyester borders are more rugged, and thus aid in preventing fraying and failure along the edges. In an embodiment, the warp and weft yarns at all four edges of the terry cloth product 20 have high polyester content, extending the high content polyester around the entire perimeter of the terry cloth product, although in alternate embodiments only a portion of the edges may include the high polyester content yarns.

In addition, as described below, reinforcing ribs, also formed from yarns having a high polyester content, may be provided that extend from a border on one side of the terry cloth product to a border on the other side. The ribs anchor to the borders, limiting failure at the juncture of the border and the adjacent cotton pile. The entire structure of the high polyester content ribs and borders provides structural dimensional stability for the terry cloth product.

Typically, as is known, the pile or ground of a terry cloth product is made on a loom, by interlacing weft yarns into warp yarns on the loom. Loop yarns are added during the weaving process. In the embodiment shown in FIG. 1, a weft direction is shown by the double arrow 22 and the warp direction is shown by the double arrow 24, but these directions may be swapped in alternative embodiments. A plurality of weft yarns 26 (FIG. 2) extend in the weft direction 22 and a plurality of warp yarns 28 extend in the warp direction 24. These weft and warp yarns 26, 28 are interlaced using a loom in a manner known in the art to form pile fabric 29 for the terry cloth product 20.

Figure 2:
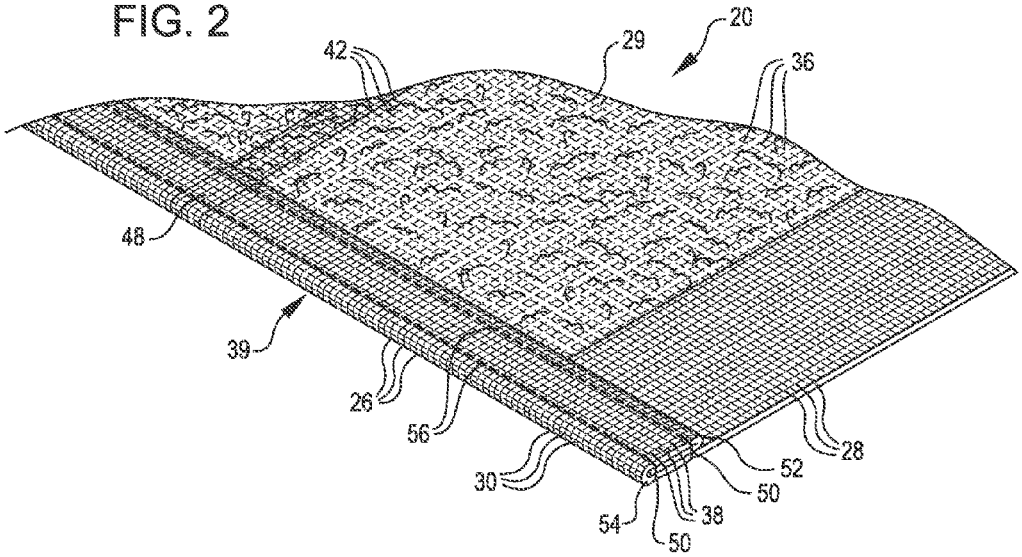
FIG. 2 is a detail view of a corner of the terry cloth product of FIG. 1, with a first border formed into a hem in accordance with an embodiment.

The weft yarns 26 include weft border yarns 30 and 32 at outer edges. The weft border yarns 30, 32 form weft borders 31, 33 at opposite ends of the terry cloth product 20. Spaced apart between the weft borders 31, 33 are a plurality of weft ribs 35 (FIG. 1) formed by weft rib yarns 34. The remainder of the weft yarns 26 are ground weft yarns 36 (FIG. 2).

The warp yarns 28 include warp border yarns 38, 40 at outer edges, and ground warp yarns 42 in between. The warp border yarns 38, 40 form warp borders 39, 41.

In accordance with an embodiment, the weft border yarns 30, 32, the weft rib yarns 34, and the warp border yarns 38, 40 are formed of a structurally stronger yarn than the ground weft yarns 36 and the ground warp yarns 42. In an embodiment, because cotton is strongly desired for terry cloth products, such as the terry cloth product 20, the ground weft yarns 36 and the ground warp yarns 42 are 100% cotton, or, at a minimum, a high content cotton that provides good feel and absorbency. A manufacturer may alter the content of the ground weft yarns 36 as desired, keeping in mind that adding polyester increases strength and reduces costs, but possibly in exchange with a loss in feel and absorbency. In an embodiment, the fiber content of the entire terry cloth product 20, including the borders and the ribs, is 95 to 97 percent cotton.

In an embodiment, the weft border yarns 30, 32, and the warp border yarns 38, 40 are formed of structurally stronger yarns than the ground weft and ground warp yarns 36, 42. Typically, when terry cloth products, such as the terry cloth product 20, are laundered, the edges and hems are subjected to an inordinate amount of friction and abrasion, resulting in processing damage and failure. To alleviate this problem, in accordance with an embodiment, structurally strong, such as high polyester content, yarns, are used along the selvage (side or warp) edges (i.e., for the warp border yarns 38, 40), as well as the fill (weft or end hem) edges (i.e., for the weft border yarns 30, 32). This construction permits the terry cloth product 20 to better survive the laundering process, primarily by limiting edge fraying or failure. If desired, this feature may be provided on just the selvage edges, only the fill edges, or both.

Similarly, the weft rib yarns 34 are structurally stronger than the ground weft and ground warp yarns 36, 42. As such, as described below, the weft ribs 35 provide structural strength and dimensional stability for the terry cloth product 20.

In an embodiment, the weft border yarns 30, 32, the weft rib yarns 34, and the warp border yarns 38, 40 are, for example, cotton/polyester blended yarns, with high polyester content. As an example, the yarns used in these areas may include 35% to 50% polyester content, and, more preferably, 50% polyester content. The content of the fibers of the weft border yarns 30, 32, the weft rib yarns 34, and the warp border yarns 38, 40 do not have to be identical, but in an embodiment, the three areas use yarns having the same content.

In an embodiment, pile yarns 46 for the terry cloth product 20 are formed of 100% cotton. This feature permits the rougher polyester rib and border yarns to be imbedded under or twisted within the cotton surface provided by the pile yarns.

The number of weft rib yarns 34 may be selected to provide a desired thickness for the weft ribs 35. Generally, the number of weft rib yarns 34 is selected so that the weft ribs 35 provide dimensional stability and structural strength for the terry cloth product 20. In an embodiment, the weft ribs 35 are between ½ and ¾ inches each in thickness, and preferably three quarters (¾) of an inch in thickness.

The weft ribs 35 are preferably spaced so that they provide dimensional stability and structural strength for the terry cloth product 20, while minimizing the amount of non-cotton yarns in the terry cloth product. In an embodiment, where three quarter (¾) inch ribs 34 are utilized on a full sized bath towel, for example 24 inches by 48 inches, the weft ribs are spaced three (3) to seven (7) inches on center, and more preferably six and one half inches on center. Different dimensions may be used, based upon the size of the terry cloth product 20, and the width of each of the weft ribs 34. In an embodiment, for smaller terry cloth products, such as a washcloth, no ribs, or a single small rib, may be provided.

Figure 3:
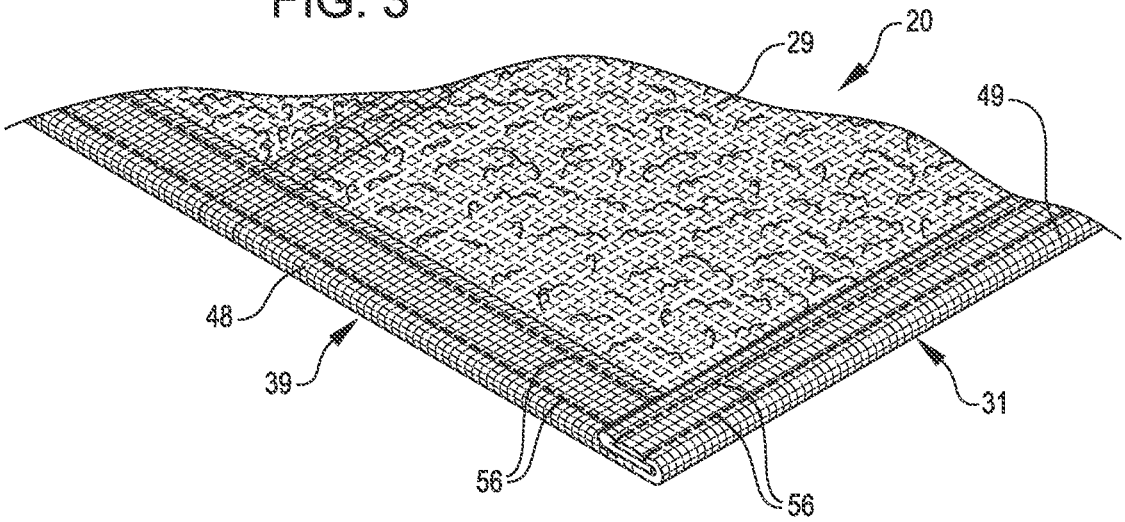
FIG. 3 is a detail view of the corner of the terry cloth product of FIG. 2, with a second border formed into a hem in accordance with an embodiment.

In accordance with an embodiment, the borders 31, 33, 39, 41 formed by the four border yarns 30, 32, 38, and 40 are sewn rather than tucked or formed into blown selvage. The borders 31, 33, 39, 41 are each sewn into a hem, such as is shown in FIG. 2. FIG. 2 shows a hem 48 being formed in a first step along the border 31, and FIG. 3 shows a second step of adding a second hem 49 along the border 41. The hems 48, 49 may be provided on all borders, or any subset of the borders.

As shown in FIG. 2, and in accordance with an embodiment, the hem 48 includes hem yarns 50 along the lower surface, a first fold line 52, and a second fold line 54. This doubled-over hem 48 provides an advantage in that the end edges of the terry cloth product 20 are not exposed, but instead are wrapped inside the doubled-over hem.

In accordance with an embodiment, a double needle, or two needle, sewing machine is utilized to provide double stitching 56 of the doubled-over hem 48. The double stitching 56 provides two stitches instead of the conventional single stitch model, providing a backup stitch in case of failure. Very often, during a laundering process, bleach is used to remove residual stains. Residual bleach left in a towel or other terry cloth product during a laundering process can disintegrate a single yarn. Thus, utilizing two needle construction and the double stitch 56 as shown in FIG. 2 provides a more stable hem 48. The hem 49 is preferably formed in the same manner, first being doubled over, and then doubled stitched. Furthermore, in addition to two-needle stitching, the type of stitching may be altered to a particular product. Any of several stitch types can be used to hold the seams together; straight-stitch, lock-stitch, zig-zag, chain-stitch, overlock stitch or blind-stitch.

EXAMPLE

An example of a terry cloth product, such as the terry cloth product 20, formed in accordance with an embodiment herein, is now described. The example is for a towel for use in the hospitality industry (for example, 24 inches by 48 inches). For this particular example, three different yarns are used. The yarns described below are examples, and variations in content, twists per inch, and amount used could be provided in accordance with embodiments described herein.

The weft borders 31, 33, the weft ribs 35, and the warp borders 39, 41: a 50% cotton/50% polyester yarn with 15 twists per inch is used to provide structural integrity for the edges of the terry cloth product and for the reinforcing ribs 35.

The ground weft yarns 36 and the ground warp yarns 42: a 100% single ply cotton yarn with 15 twists per inch is used in all other warp and weft fill directions except for the ¾" reinforcing ribs which shall be the 50% polyester and 50% cotton yarns.

The pile yarns 46: a 100% single ply cotton yarn with 15 twists per inch is used for the pile yarns.

Looms (not shown, but known) are set up so that the warp yarns 38, 40 along each of the edges are woven with the 50% cotton/50% polyester yarns. These warp yarns 38, 40 form the warp borders 39, 41. The rest of the warp yarns (i.e., the ground warp yarns 42) are the 100% cotton single ply cotton yarns with the 17 twists per inch.

The weft yarns are interwoven into the warp yarns, with an initial three quarter (¾) inch wide band of weft border yarns 30 for one of the weft borders 31, followed by the cotton ground weft yarns 36. Thus, the source of weft yarns should be changed during the weaving process. The reinforcing bands or weft rib yarns 34 are interwoven at between approximately 3 inches and 6 inches off center from one another, ¾ inch in width. Each time a change is made from border to ground, ground to rib, rib to ground, or ground to border, the source of weft yarns is changed. During the weaving process, the pile yarns 46 are woven into the pile fabric.

After the pile fabric has been woven, the terry cloth product 20 is cut to length and width. The areas along the warp borders 38, 40 are then doubled over and sewn, using a two needle sewing machine to fix the hems 48. The weft borders 31, 33 are then doubled over to create similar hems, also with double stitches 56.

In addition to protecting the selvage, the warp borders 39, 41 are anchored to the ends of the weft ribs 34. The doubled-over hems 48 provide an interlocking connection between the weft ribs 35 and the warp borders 39, 41, providing a structural network for dimensional stability and structural strength of the terry cloth product 20.

If desired, support ribs may be provided in the warp direction. However, the weft ribs 35 are arranged to minimize the typical shrinkage and border issues in a terry cloth product. Usually, there are twice as many yarns in a warp direction as there are in a weft direction. Warp yarns may be arranged very tightly on the warp beam (not shown, but known in the loom art) and, after being removed from the loom, even after many washes, there is not much shrinkage in the weft direction because of the tightness of the warp yarns. However, weft yarns, which are pulled through the loom, are not pulled as tightly together. Thus, there can be much shrinkage in the warp direction. This shrinkage can often result in distortion at the edges and/or dimensional instability in the warp direction due to uneven shrinkage. The warp borders 39, 41 aid in preventing fraying at the edges, and the weft ribs 35 prevent the warp borders 39 from releasing from the edges, and provide dimensional stability across the weft direction. If the edges were reinforced with only the warp borders 38, 40, these warp borders may release as a result of shrinkage and wear of the terry cloth product in the area adjacent to the warp borders. The weft ribs 34 provide structural support and strength in the weft direction and dimensional stability, and help to anchor the warp borders 38, 40 in place. To this end, the spacing of the weft ribs 35 may be selected to properly balance the goals of properly anchoring the warp borders and maximizing the amount of cotton used in the terry cloth product. In addition, as described above, the terry cloth product may be formed so that the total cotton content of the product may meet a desired goal, such as 95 to 97 percent cotton.

Testing by an independent testing agency was obtained and is included at Appendix A. Towels utilizing the structures herein passed all standard towel tests.

In addition to the testing at Appendix A, towels were used over the course of a month, and an evaluation of towels formed in accordance with the specifications for Example 1 were found to have no quality, overall performance, processing, or guest reported issues. Drying time was slightly down compared to 100% cotton towels, selvage edges were not frayed, and soil and stain removal were improved. Comments on the towels were positive, and estimates were that linen life should be increased, and cost should be significantly reduced.

Other variations are within the spirit of the present invention. Thus, while the invention is susceptible to various modifications and alternative constructions, certain illustrated embodiments thereof are shown in the drawings and have been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

All references, including publications, patent applications, and patents, cited herein are hereby incorporated by reference to the same extent as if each reference were individually and specifically indicated to be incorporated by reference and were set forth in its entirety herein.

What is claimed is:

1. A terry cloth product, comprising:

a ground center comprising cotton;

an outer border along at least two edges of the terry cloth product, the border comprising more polyester than the ground center; and a rib extending across the ground center from one edge of the border to another edge of the border, the rib comprising more polyester than the ground center.

2. The terry cloth product of claim 1, wherein the ground center comprises substantially all cotton.

3. The terry cloth product of claim 1, wherein the outer border comprises a high polyester content, cotton/polyester blend.

4. The terry cloth product of claim 3, wherein the outer border comprises a polyester fiber content of approximately 50%.

5. The terry cloth product of claim 1, wherein the rib extending across the cotton ground center comprises a high polyester content, cotton/polyester blend.

6. The terry cloth product of claim 5, wherein the rib comprises a polyester fiber content of approximately 50%.

7. The terry cloth product of claim 1, further comprising a plurality of ribs, each rib extending across the ground center from the one edge of the border to the another edge of the border.

8. The terry cloth product of claim 1, wherein each outer border edge comprises a doubled over hem.

9. The terry cloth product of claim 8, wherein the doubled over hems of the outer border comprise two needle stitching.

10. The terry cloth product of claim 8, wherein each of the ribs extends through two of the doubled over hems of the outer border.

11. A terry cloth product, comprising:

a center comprising a first material;

a border comprising a second material along at least two edges of the terry cloth product; and at least one rib extending across the center from one edge of the border to another edge of the border, the at least one rib comprising a third material, wherein the third material and the second material are each structurally stronger than the first material.

12. The terry cloth product of claim 11, wherein the third material is the same as the second material.

13. The terry cloth product of claim 11, wherein the third material is different from the second material.

14. The terry cloth product of claim 11, wherein the first material comprises cotton.

15. The terry cloth product of claim 11, wherein the second and third materials each comprise more polyester than the first material.

16. The terry cloth product of claim 11, wherein a polyester content of the first material is approximately 0%.

17. The terry cloth product of claim 11, wherein a polyester content of the second material is approximately 50%.

18. The terry cloth product of claim 11, wherein a polyester content of the third material is approximately 50%.

19. The terry cloth product of claim 11, further comprising a plurality of ribs, each rib extending across the ground center from one edge of the border to another edge of the border.

20. The terry cloth product of claim 11, wherein each border edge comprises a doubled over hem.

21. The terry cloth product of claim 20, wherein the doubled over hems of the border comprise two needle stitching.

22. The terry cloth product of claim 20, wherein each of the ribs extends through two of the doubled over hems of the border.

23. A terry cloth product, comprising:

a pile fabric comprising:

a width and a length;

first and second length edges;

a first set of yarns extending lengthwise and forming a first set of reinforcement yarns along the first length edge, and a second set of reinforcement yarns along the second length edge;

a second set of yarns extending lengthwise and between the first and second sets of reinforcement yarns; and a third set of yarns forming at least one widthwise set of reinforcement yarns extending widthwise between and into the first and second sets of reinforcement yarns;

wherein the first, second, and third sets of yarns each comprise cotton, and wherein the first and third sets of yarns each comprise structurally stronger yarns than the yarns of the second set of yarns.

24. The terry cloth product of claim 23, wherein the second set of yarns comprises mostly cotton.

25. The terry cloth product of claim 23, wherein a polyester content of the first set of yarns is approximately 50%.

26. The terry cloth product of claim 23, wherein a polyester content of the third set of yarns is approximately 50%.

27. The terry cloth product of claim 23, further comprising a plurality of sets of widthwise reinforcing yarns comprising the set of third yarns, each of the sets of widthwise reinforcing yarns extending between the first and second sets of reinforcement yarns.

28. The terry cloth product of claim 23, wherein the first and second sets of reinforcement yarns each comprise a doubled over hem.

29. The terry cloth product of claim 28, wherein the doubled over hems for the first and second sets of reinforcement yarns comprise two needle stitching.

30. The terry cloth product of claim 28, wherein each of the widthwise sets of reinforcing yarns extends through the doubled over hems at the first and second sets of reinforcement yarns.

* * * * *

UNITED STATES PATENT AND TRADEMARK OFFICE

CERTIFICATE OF CORRECTION

PATENT NO. : 8,678,044 B2
APPLICATION NO. : 13/939038
DATED : March 25, 2014
INVENTOR(S) : Sidney Rabin, Glen Paul Phillips and Dewey Todd It is certified that error appears in the above-identified patent and that said Letters Patent is hereby corrected as shown below:

Appendix filed with application but not included with Letters Patent.

Insert Appendix after Abstract and before Drawings

Signed and Sealed this
Fifth Day of August, 2014

Michelle K. Lee

Michelle K. Lee
*Deputy Director of the United States Patent and Trademark Office*

APPENDIX A

--

Terry Towel Testing Project for

HOLIDAY INN EXPRESS

HOTEL GROUP

PREPARED BY

SCIENTIFIC SERVICES DIVISION

OF

PHILLIPS & ASSOCIATES, INC.

May 4, 2009

2781 Freeway Blvd, Suite 120
Brooklyn Center, MN 55430 USA
Tel: 651-288-4950 Fax: 651-636-3646
E-Mail Address: pa-i@phillipsandassociates.com
Web Site: www.phillipsandassociates.com 2781 Freeway Blvd., Suite 120
Brooklyn Center, MN 55430 USA
Tel: 763-231-9950 Fax: 763-231-9951
E-Mail Address: pa-l@phillipsandassociates.com
Web Site: www.phillipsandassociates.com

TABLE OF CONTENTS
For
HOLIDAY INN EXPRESS HOTEL GROUP
TERRY TOWEL TESTING

| | |
|---|---|
| Title Page | Page 1 |
| Table of Contents | Page 2 |
| Introduction to Report | Pages 3-4 |
| Executive Summary | Pages 5-6 |
| Initial Pre-Wash Testing Report | Pages 7-9 |
| Table One – Fabric Analysis and Tensile Strength | Page 10 |
| Table Two – Reflectance | Page 10 |
| Table Three – Flaws | Page 11 |
| Table - 4, Dimensional Data, Initial | Page 12 |
| Test Determinations After First Wash/Dry Cycle | Pages 13-14 |
| Table –5, Dimensional Data After First Wash/Dry Cycle | Page 15 |
| Test Determinations after Tenth Wash/Dry Cycle | Pages 16-17 |
| Table -6, Dimensional Data, after Tenth Wash/Dry Cycle | Page 18 |
| Test Determinations After Twenty-five Wash/Dry Cycles | Pages 19-20 |
| Table –7, Dimensional Data, After Twenty-five Wash/Dry Cycles | Page 21 |
| Test Determinations After Fifty Wash/Dry Cycles | Page 22-23 |
| Table - 8, Dimensional Data, After Fifty Wash/Dry Cycles | Page 24 |

2781 Freeway Blvd, Suite 120
Brooklyn Center, MN 55432 USA
Tel: 763-231-9950 Fax: 763-231-9951
E-Mail Address: po-i@phillipsandassociates.com
Web Site: www.phillipsandassociates.com

INTRODUCTION

The Laboratory of Phillips & Associates, Inc., Scientific Services Division received three (3) lots of Bath Towels to be tested for the Holiday Inn Express Hotel Group.

Breakdown of Received Goods

The samples received are shown by product identifier, with the PPI (Phillips Product Identifier number) assigned to each individual lot on the list below.

Nine of each of the following bath towel lots were received from Guest Supply:

| Product Name | Phillips Identifier |
|---|---|
| ***Guest Supply- New Patent*** | 0904449 |

[Product specifications indicate 100% cotton, 27 X 54, 15 pounds/dozen,(country of origin - India)]

*Guest Supply – Comfort Collection* 0904451
[Product specifications indicate 85/15 blend, 27 X 50, 15 pounds/dozen, (country of origin – Pakistan)]

*Guest Supply – Currently Used* 0904452
[Product specifications indicate 100% cotton, 27 X 54, 17 pounds/dozen, (country of origin – India)]

Each item within each lot was assigned an identifier (0-8). The PPI numbers (Phillips Identifier) will follow each item throughout the test period.

Test Process

The following tests and analyses were performed to determine and compare the physical characteristics of the materials.

1. Dimensional Analysis [ASTM D-3774]
2. Fabric Content [ASTM D-629]
3. Visual Analysis [ASTM D-3990]

4. Weight per square yard/meter [ASTM D-3776]

5. Tensile strength warp and weft (fill) [ASTM D-5034]

6. Reflectance HunterLab Spectrophotometer

7. Construction Analysis [ASTM D-3775]
   Thread count warp, fill and total (ASTM: American Society for Testing and Materials standards)

The results of the testing will be found tabulated on tables throughout the report at the various test intervals (i.e., prior to processing, after one wash/dry cycle, after ten wash/dry cycles, after twenty-five wash/dry cycles, and after fifty wash/dry cycles). These tables will be accompanied by a brief overview of the testing at that stage in the testing process.

Washing Process

All goods were processed in the same batch to ensure uniformity of treatment. The wash process used is as follows (drying at or about 180 $^0$F):

| Operation | Time | Temp. | Level | Product | Amount |
|---|---|---|---|---|---|
| Break/Bleach | 10 Minutes | Hot | Low | Builder C<br>E.S. Det. Plus<br>E.S. Destainer | 4.0 ozs. Cwt.<br>1.0 ozs. Cwt.<br>5.0 ozs. Cwt. |
| Rinse | 2 Minutes | Hot | High | | |
| Rinse | 2 Minutes | Split | High | | |
| Rinse | 2 Minutes | Split | High | | |
| Sour/Soft | 5 Minutes | Cold | Low | E.S. Sour | 1.0 ozs. Cwt. |
| Extract | | | | | |

Missing Equation: "USE"

This report does not take into account the "use" part of the cycle. That being what the goods endure under normal use circumstances. The use portion of the life cycle is filled with abuses and misuses that cannot be built into the testing process. This report cannot speak to the results of a wash/dry/"use" cycle

EXECUTIVE SUMMARY

HOLIDAY INN EXPRESS BATH TOWEL TESTING

This summary is intended to give a very brief overview of the final test results. The findings for each stage of the testing process are given in the sections and tables pertaining to each facet of the test process.

Length

All goods remained within the 10% ASTM allowable length variance for Terry Cloth Bath fabric.

Width

All of the 0904449 and 0904451 product remained within the allowable 4% ASTM width shrinkage limits for Terry Cloth Bath fabric at the end of fifty wash/dry cycles. Three of the 0904452 products (05, 06, and 08) were failing at the end of fifty cycles. 0904452-05 had failed by twenty-five cycles.

Dobby

ASTM allowable value for Bow and Skewness is 6%. For a 27" wide towel this equates to 1.67 inches.

At the end of fifty cycles five of the six remaining 0904449 and all six of the 0904452 products had failed this test and all of the 0904451 had passed. One of six of each of the 0904449 and 0904452 had failed by twenty-five cycles. Items 0904449-04 and 0904452-06 had failed at ten cycles.

Weight

Weight loss of all goods was within acceptable limits after fifty cycles.

Weight per Square Yard

The weight per square yard was acceptable for all products.

Tensile Strength of Fabric

The fabric tensile strengths on all items (please reference Table One) still well exceeded the required 40 lbf in the warp and 30 lbf in the fill direction.

Thread Count

The thread counts are shown on Table – One. ASTM thread count standards are not given for terry cloth products.

Bath Towels
0904449 – Mesh background 85 threads/sq inch, pile count 238 loops/sq inch
0904451 – Mesh background 78 threads/sq inch, pile count 252 loops/sq inch
0904452 – Mesh background 84 threads/sq inch, pile count 256 loops/sq inch

Fiber Content

The laboratory determined weights per square yard are found on Table One – Fabric Analysis. All values shown here are in ounces per square yard (grams per square meter are included on the table).

Bath Towels
0904449 – 18.55
0904451 – 19.76
0904452 – 18.55

All values are adequate.

Reflectance

Very little change is visually noticeable from the initial testing through the end of fifty cycles. All products remain within 1.05 points of the initial reading. Please reference Table Two.

All products held their whiteness very well throughout the test period.

Visual Evaluation

Defects are noted on Table Three, Page 11 of this report.

At the end of the fifty-wash/dry cycles all goods remained functional.

INITIAL PRE-WASH TESTING

Prior to beginning the 50 wash/dry cycles, the products received were all measured and weighed. These values were retained and compared to the results at each testing interval.

Supportive data for this pre-wash testing portion of the report will be found on Table One: Fabric Analysis, Table Two: Reflectance, Table Three: Flaws and Table – 4 - Dimensional Data, at the end of this section Data for the individual testing of the products (Bath Towels) will be recorded on separate tables throughout this report. The complete tables showing the individual products, by item, are at the end of each section of the report.

Length

Bath Towels – Table – 4:
0904449 - Length ranged from 52.75" to 53.69", Average 53.22"
(Product specifications indicate 54", samples are within tolerance)
0904451 – Length ranged from 50.38" to 51.25", Average 50.75"
(Product specifications indicate 50", samples are as stated)
0904452 – Length ranged from 56.13" to 56.63", Average 56.38"
(Product specifications indicate 54", samples are within tolerance)

Width

Bath Towels – Table - 4:
0904449 - Width ranged from 27.25" to 27.44", Average 27.34"
(Product specifications indicate 27", samples are as stated)
0904451 – Width ranged from 26.75" to 27.38", Average 27.04"
(Product specifications indicate 27", samples are as stated)
0904452 – Width ranged from 27.38" to 28.63", Average 28.25"
(Product specifications indicate 27", samples are above stated values)

Dobby

Bath Towels – Table - 4:
0904449 - Dobby ranged from 26.63" to 27.25", Average 27.01"
(Initial distortion equals [27.35 – 27.01]/2 = 0.17 inches)
0904451 – Dobby ranged from 26.19" to 26.69", Average 26.49"
(Initial distortion equals [27.07 – 26.49]/2 = 0.29 inches)
0904452 – Dobby ranged from 27.19" to 27.69", Average 27.32"
(Initial distortion equals [28.20 – 27.32]/2 = 0.44 inches)

Item Weight

Bath Towels – Table - 4:
0904449 - Weight ranged from 562.45g to 580.60g, Average 564.47g
(Product specifications indicate 567g, samples are within tolerance)
0904451 – Weight ranged from 517.09g to 571.51g, Average 541.28g
(Product specifications not given for this factor)
0904452 – Width ranged from 616.88g to 644.10g, Average 629.08g
(Product specifications indicate 643g, samples are within tolerance)

The significance of these values will be established when comparing the percent of change after the wash cycles.

Tensile Strength

The fabric tensile strengths on all items (please reference Table One) exceeded the required 40 lbf in the warp and 30 lbf in the fill direction.

Weight per Square Yard

The laboratory determined weights per square yard are found on Table One – Fabric Analysis. All values shown here are in ounces per square yard (grams per square meter are included on the table).

Bath Towels
0904449 – 18.55
0904451 – 19.76
0904452 – 18.55

All values are adequate.

Thread Count

The thread counts are shown on Table – One. ASTM thread count standards are not given for terry cloth products.

Bath Towels
0904449 – Mesh background 85 threads/sq inch, pile count 238 loops/sq inch
0904451 – Mesh background 78 threads/sq inch, pile count 252 loops/sq inch
0904452 – Mesh background 84 threads/sq inch, pile count 288 loops/sq inch

Fiber Content

The fiber content of all products are shown on Table -- One.

Bath Towels
0904449 – 100 % cotton
0904451 – 90% cotton/10% polyester
0904452 – 100 % cotton

Visual Evaluation

The defects noted during the initial visual inspection are recorded on Table -- Three at the end of this section.

Reflectance

The Hunter reflectance test (Table - Two) compares the whiteness of the products with a known standard white tile. The items that show a positive number value are whiter than the standard. The human eye will usually not be able to detect differences of less than two or three points.

The new products all measured within one and one-half points of the standard tile. Product 0904451 measured whiter than the standard tile and the other two were just slightly darker.

TABLE ONE - FABRIC ANALYSIS

| FABRIC TENSILE STRENGTH (Pounds Force) | | | | | | | Weight in ounces per sq Yard | Weight in grams per Sq meter |
|---|---|---|---|---|---|---|---|---|
| SKU # | Initial (prior to wash/dry | | After 25 wash./dry cycles | | After 50 wash;/dry cycles | | | |
| | Warp | Fill | Warp | Fill | Warp | Fill | | |
| 0904449 | 80.40 | 54.40 | 80.20 | 56.80 | 82.80 | 56.60 | 18.55 | 628.70 |
| 0904451 | 161.00 | 64.80 | 180.80 | 80.00 | 167.00 | 69.40 | 19.76 | 662.50 |
| 0904452 | 85.00 | 56.20 | 89.80 | 56.20 | 86.80 | 57.80 | 18.55 | 628.70 |

| THREAD COUNT | | | | |
|---|---|---|---|---|
| SKU # | Initial (prior to wash/dry procedures) | | | |
| | Warp | Fill | Total | Pile |
| 0904449 | 45 | 40 | 85 | 238 |
| 0904451 | 41 | 37 | 78 | 252 |
| 0904452 | 46 | 38 | 84 | 288 |

| FABRIC CONTENT | | | |
|---|---|---|---|
| SKU # | Weight of sample before acid bath | Weight of sample after acid bath | % Cotton |
| 0904449 | 2.9 g | 0 g | 100 % |
| 0904451 | 2.9 g | 0.3 g | 89.65 % |
| 0904452 | 3.2 g | 0 g | 100% |

TABLE TWO - REFLECTANCE

| REFLECTANCE (Positive deviation indicates whiter than standard) | | | | | | | | | |
|---|---|---|---|---|---|---|---|---|---|
| SKU # | White Standard, Hunter Tile | New unwashed | deviation from Standard | One wash-dry cycle | deviation from Initial reading | Twenty-five wash-dry cycles | deviation from Initial reading | Fifty wash-dry cycles | deviation from Initial reading |
| 0904449 | 93.99 | 92.56 | -1.43 | 91.65 | 0.91 | 92.84 | -0.28 | 92.50 | 0.06 |
| 0904451 | 93.99 | 94.65 | 0.66 | 92.49 | 2.16 | 93.57 | 1.08 | 93.60 | 1.05 |
| 0904452 | 93.99 | 93.79 | -0.20 | 92.31 | 1.48 | 93.01 | 0.78 | 92.86 | 0.93 |

TABLE THREE - FLAWS

| PPI # | ITEM # | INITIAL | AFTER (1) WASH/DRY CYCLE | AFTER (10) CYCLES | AFTER (25) CYCLES | AFTER (50) CYCLES |
|---|---|---|---|---|---|---|
| 0904449 | 00 | 1 yarn pull | | | | |
| 0904449 | 01 | | | | | |
| 0904449 | 02 | 2 yarn pulls, 1 broken yarn | 4 yarn pulls, 1 broken yarn | 1 yarn pull | | |
| 0904449 | 03 | 1 yarn pull | 1 yarn pull | | | |
| 0904449 | 04 | 5 yarn pulls | 1 yarn pull | 1 yarn pull | | |
| 0904449 | 05 | | 3 broken yarns | 2 yarn pulls | | 1 yarn pull |
| 0904449 | 06 | | | | | 1 yarn pull |
| 0904449 | 07 | | 1 yarn pull | 1 yarn pull | | |
| 0904449 | 08 | 2 yarn pulls | 2 yarn pulls | | selvage pilling | 1 yarn pull |
| 0904451 | 00 | | | | | |
| 0904451 | 01 | 3 yarn pulls | | | | |
| 0904451 | 02 | 1 broken yarn | 1 broken yarn | 3 yarn pulls | Product tags all show wear fraying | |
| 0904451 | 03 | 1 yarn pull | 4 yarn pulls | 3 yarn pulls | | |
| 0904451 | 04 | 3 yarn pulls | | | | |
| 0904451 | 05 | | 2 yarn pulls | | | |
| 0904451 | 06 | | | | | |
| 0904451 | 07 | | | 2 yarn pulls | | |
| 0904451 | 08 | 3 yarn pulls, 1 broken yarn | | | | |
| 0904452 | 00 | 1 broken yarn | | | | |
| 0904452 | 01 | | | | | |
| 0904452 | 02 | 1 broken yarn | | | 1 yarn pull | |
| 0904452 | 03 | | 2 yarn pulls | | | |
| 0904452 | 04 | 1 yarn pull, 2 broken yarns | | 1 yarn pull | | |
| 0904452 | 05 | 1 broken yarn | 1 broken yarn | 3 yarn pulls | | |
| 0904452 | 06 | 2 yarn pulls, 2 broken yarns | 2 broken yarns | 1 yarn pull | | |
| 0904452 | 07 | | 1 broken yarn | | | |
| 0904452 | 08 | 1 yarn pull, 1 broken yarns | | 1 yarn pull | | |

TABLE 4 - INITIAL DIMENSIONS

| PHILLIPS IDENTIFIER | Weight | | Dimensions (inches) | | |
|---|---|---|---|---|---|
| | grams | lbs | Length | Width | Dobby |
| **GUEST SUPPLY- NEW PATENT** | | | | | |
| 0904449-00 | 562.45 | 1.24 | 53.31 | 27.44 | 27.03 |
| 0904449-01 | 562.45 | 1.24 | 53.69 | 27.38 | 27.00 |
| 0904449-02 | 562.45 | 1.24 | 53.25 | 27.25 | 27.00 |
| 0904449-03 | 562.45 | 1.24 | 53.25 | 27.25 | 27.00 |
| 0904449-04 | 562.45 | 1.24 | 53.00 | 27.38 | 27.06 |
| 0904449-05 | 562.45 | 1.24 | 53.06 | 27.38 | 27.25 |
| 0904449-06 | 562.45 | 1.24 | 53.56 | 27.38 | 27.13 |
| 0904449-07 | 562.45 | 1.24 | 53.13 | 27.25 | 27.00 |
| 0904449-08 | 580.60 | 1.28 | 52.75 | 27.38 | 26.63 |
| **AVERAGE** | **564.47** | **1.24** | **53.22** | **27.34** | **27.01** |
| **GUEST SUPPLY- 85/15% STD** | | | | | |
| 0904451-00 | 571.52 | 1.26 | 50.63 | 27.38 | 26.56 |
| 0904451-01 | 571.52 | 1.26 | 50.75 | 27.06 | 26.50 |
| 0904451-02 | 571.52 | 1.26 | 50.38 | 27.25 | 26.63 |
| 0904451-03 | 517.09 | 1.14 | 51.25 | 26.75 | 26.19 |
| 0904451-04 | 517.09 | 1.14 | 51.13 | 26.88 | 26.38 |
| 0904451-05 | 535.24 | 1.18 | 50.56 | 27.13 | 26.56 |
| 0904451-06 | 535.24 | 1.18 | 50.50 | 27.00 | 26.69 |
| 0904451-07 | 535.24 | 1.18 | 50.44 | 27.00 | 26.63 |
| 0904451-08 | 517.09 | 1.14 | 51.13 | 26.88 | 26.25 |
| **AVERAGE** | **541.28** | **1.19** | **50.75** | **27.04** | **26.49** |
| **GUEST SUPPLY - IN-USE NOW** | | | | | |
| 0904452-00 | 616.88 | 1.36 | 56.38 | 28.38 | 27.25 |
| 0904452-01 | 616.88 | 1.36 | 56.63 | 28.19 | 27.38 |
| 0904452-02 | 625.95 | 1.38 | 56.63 | 28.00 | 27.19 |
| 0904452-03 | 625.95 | 1.38 | 56.25 | 28.06 | 27.19 |
| 0904452-04 | 644.10 | 1.42 | 56.63 | 28.00 | 27.00 |
| 0904452-05 | 635.03 | 1.40 | 56.25 | 28.63 | 27.69 |
| 0904452-06 | 625.95 | 1.38 | 56.31 | 28.38 | 27.38 |
| 0904452-07 | 626.88 | 1.36 | 56.25 | 27.88 | 27.31 |
| 0904452-08 | 644.10 | 1.42 | 56.13 | 28.25 | 27.50 |
| **AVERAGE** | **629.08** | **1.38** | **56.38** | **28.20** | **27.32** |

TEST DETERMINATIONS AFTER THE FIRST WASH/DRY CYCLE

At the end of the first wash/dry cycle the items were measured and weighed in the same manner as before processing began (please reference Table - 5 at the end of this section). The changes in measurements are shown on the table both as a numerical value and as a percentage.

Length

Negative values indicate a relaxing of the fiber weave, which is not uncommon. ASTM allowable length shrinkage is 10% for Terry Bath Towels.

Bath Towels – Table – 5:
0904449 - Change ranged from 3.32% to 4.37%, Average 3.85%
0904451 – Change ranged from 4.20% to 4.94%, Average 4.57%
0904452 – Change ranged from 5.88% to 7.95%, Average 6.73%

All goods are within tolerance.

Width

Negative values indicate a relaxing of the fiber weave, which is not uncommon. ASTM allowable width shrinkage is 4% for Terry Bath Towels.

Bath Towels – Table – 5:
0904449 - Change ranged from 0.47% to 2.06%, Average 1.22%
0904451 – Change ranged from –0.48% to 0.93%, Average 0.40%
0904452 – Change ranged from –0.21% to 3.49%, Average 1.83%

All goods are within tolerance.

Dobby

ASTM allowable value for Bow and Skewness is 6%. For a 27" wide towel this equates to 1.67 inches.

Bath Towels – Table - 5:
0904449 - Change ranged from 0.94" to 1.50", Average 1.18"
0904451 – Change ranged from 0.12" to 0.82", Average 0.48"
0904452 – Change ranged from 1.19" to 2.06", Average 1.25" (0904452-04 fail)

All goods average within tolerance.

Item Weight

Bath Towels – Table - 5:
0904449 - Change ranged from 9.08g to 27.21g, Average 15.87g
0904451 – Change ranged from 9.07g to 18.15g, Average 15.55g
0904452 – Change ranged from 9.07g to 27.22g, Average 16.98g

Visual Evaluation

Defects are noted on Table Three, Page 11 of this report.

Reflectance

Very little change is visually noticeable from the initial testing. All products remain within 2.16 points of the initial reading (The human eye can barely discern a difference of 2 or 3 points). Please reference Table Two.

TABLE - 5 - DIMENSIONAL DATA AFTER ONE WASH/DRY CYCLE

| GUEST SUPPLY - NEW PATENT | | | | | | | | | | | | | | | | | | |
|---|---|---|---|---|---|---|---|---|---|---|---|---|---|---|---|---|---|---|
| Initial Sample | | | | | After one (1) wash/dry cycle | | | | | | | | | | | | | |
| Weights (grams) & Measurements (inches) | | | | | Dimensions in inches | | | | | | | | | | Weight in Grams | | |
| SKU | Weight (grams) | Warp | Weft | Dobby | Warp (inches) | Actual Change | % Change | Weft (inches) | Actual Change | % Change | Dobby (inches) | Actual Change | % Change | Dobby Indent | Weight (grams) | Actual Change | % Change |
| 0904449-00 | 562.45 | 53.31 | 27.44 | 27.03 | Control Item (not tested) | | | | | | | | | | | | |
| 0904449-01 | 562.45 | 53.69 | 27.38 | 27.63 | Item 01 used in destructive analysis | | | | | | | | | | | | |
| 0904449-02 | 562.45 | 53.25 | 27.25 | 27.00 | 51.25 | 2.00 | 3.76 | 26.69 | 0.56 | 2.06 | 25.75 | 0.94 | 3.48 | 0.47 | 535.24 | 27.21 | 4.84 |
| 0904449-03 | 562.45 | 53.25 | 27.25 | 27.00 | 51.25 | 2.00 | 3.76 | 27.00 | 0.25 | 0.92 | 25.88 | 1.12 | 4.15 | 0.56 | 544.31 | 18.14 | 3.23 |
| 0904449-04 | 562.45 | 53.00 | 27.38 | 27.06 | 51.00 | 2.00 | 3.77 | 27.25 | 0.13 | 0.47 | 25.75 | 1.50 | 5.54 | 0.75 | 544.31 | 18.14 | 3.23 |
| 0904449-05 | 562.45 | 53.06 | 27.38 | 27.25 | 50.88 | 2.18 | 4.11 | 27.06 | 0.32 | 1.17 | 25.88 | 1.18 | 4.33 | 0.59 | 544.31 | 18.14 | 3.23 |
| 0904449-06 | 562.45 | 53.56 | 27.38 | 27.13 | 51.50 | 2.06 | 3.85 | 26.69 | 0.50 | 1.83 | 25.94 | 0.94 | 3.46 | 0.47 | 544.31 | 18.14 | 3.23 |
| 0904449-07 | 562.45 | 53.13 | 27.25 | 27.00 | 50.81 | 2.32 | 4.37 | 27.06 | 0.19 | 0.70 | 26.00 | 1.06 | 3.93 | 0.53 | 544.31 | 18.14 | 3.23 |
| 0904449-08 | 580.60 | 52.75 | 27.38 | 26.63 | 51.00 | 1.75 | 3.32 | 27.00 | 0.38 | 1.39 | 25.50 | 1.50 | 5.63 | 0.75 | 571.52 | 9.08 | 1.56 |
| AVERAGE | 564.47 | 53.22 | 27.34 | 27.01 | 51.10 | 2.04 | 3.85 | 26.99 | 0.33 | 1.22 | 25.81 | 1.18 | 4.36 | 0.59 | 546.90 | 19.87 | 3.32 |
| LOW | 562.45 | 52.75 | 27.24 | 26.63 | 50.81 | 1.75 | 3.32 | 26.69 | 0.13 | 0.47 | 25.50 | 0.94 | 3.46 | 0.50 | 535.24 | 9.08 | 1.56 |
| HIGH | 580.60 | 53.56 | 27.44 | 27.25 | 51.50 | 2.32 | 4.37 | 27.25 | 0.56 | 2.06 | 26.00 | 1.50 | 5.63 | 0.63 | 571.52 | 27.21 | 4.84 |
| RANGE | 18.15 | 0.81 | 0.19 | 0.62 | 0.69 | 0.57 | 1.05 | 0.56 | 0.43 | 1.59 | 0.50 | 0.56 | 2.17 | 0.13 | 36.28 | 18.13 | 3.28 |

| GUEST SUPPLY - (85/15) SPOT | | | | | | | | | | | | | | | | | | |
|---|---|---|---|---|---|---|---|---|---|---|---|---|---|---|---|---|---|---|
| Initial Sample | | | | | After one (1) wash/dry cycle | | | | | | | | | | | | | |
| Weights (grams) & Measurements (inches) | | | | | Dimensions in inches | | | | | | | | | | Weight in Grams | | |
| SKU | Weight (grams) | Warp | Weft | Dobby | Warp (inches) | Actual Change | % Change | Weft (inches) | Actual Change | % Change | Dobby (inches) | Actual Change | % Change | Dobby Indent | Weight (grams) | Actual Change | % Change |
| 0904451-00 | 571.52 | 50.63 | 27.38 | 26.56 | Control Item (not tested) | | | | | | | | | | | | |
| 0904451-01 | 571.52 | 50.75 | 27.06 | 26.56 | Item 01 used in destructive analysis | | | | | | | | | | | | |
| 0904451-02 | 571.52 | 50.38 | 27.25 | 26.63 | 45.25 | 2.13 | 4.23 | 27.08 | 0.19 | 0.70 | 26.38 | 0.69 | 2.55 | 0.34 | 562.45 | 9.07 | 1.59 |
| 0904451-03 | 517.09 | 51.25 | 26.75 | 26.19 | 46.88 | 2.37 | 4.62 | 26.63 | 0.12 | 0.45 | 26.06 | 0.57 | 2.15 | 0.29 | 498.95 | 18.14 | 3.51 |
| 0904451-04 | 517.09 | 51.13 | 26.38 | 26.38 | 46.75 | 2.38 | 4.65 | 26.80 | 0.00 | 0.00 | 26.06 | 0.62 | 2.11 | 0.41 | 498.95 | 18.14 | 3.51 |
| 0904451-05 | 535.24 | 50.56 | 27.13 | 26.56 | 46.06 | 2.50 | 4.94 | 27.00 | 0.13 | 0.46 | 26.88 | 0.12 | 0.45 | 0.00 | 526.16 | 9.08 | 1.70 |
| 0904451-06 | 535.24 | 50.50 | 27.00 | 26.69 | 46.38 | 2.12 | 4.20 | 26.75 | 0.25 | 0.93 | 26.38 | 0.37 | 1.39 | 0.19 | 517.09 | 18.15 | 3.39 |
| 0904451-07 | 535.24 | 50.44 | 27.06 | 26.63 | 46.13 | 2.31 | 4.68 | 27.13 | -0.13 | -0.48 | 26.44 | 0.69 | 2.59 | 0.34 | 517.09 | 19.15 | 3.39 |
| 0904451-08 | 517.09 | 51.13 | 26.88 | 26.25 | 46.69 | 2.44 | 4.77 | 26.89 | 0.19 | 0.71 | 26.13 | 0.56 | 2.13 | 0.28 | 498.95 | 18.14 | 3.51 |
| AVERAGE | 541.26 | 50.75 | 27.04 | 26.49 | 46.45 | 2.32 | 4.57 | 26.88 | 0.11 | 0.40 | 26.33 | 0.48 | 1.80 | 0.27 | 517.09 | 16.66 | 2.94 |
| LOW | 517.09 | 50.38 | 26.75 | 26.19 | 45.88 | 2.12 | 4.20 | 26.63 | -0.13 | -0.48 | 26.06 | 0.12 | 0.45 | 0.16 | 498.95 | 9.07 | 1.59 |
| HIGH | 571.52 | 51.25 | 27.38 | 26.63 | 46.88 | 2.50 | 4.94 | 27.13 | 0.25 | 0.93 | 26.88 | 0.62 | 3.11 | 0.19 | 562.45 | 18.15 | 3.51 |
| RANGE | 54.43 | 0.87 | 0.63 | 0.50 | 0.62 | 0.38 | 0.74 | 0.50 | 0.38 | 1.41 | 0.82 | 0.70 | 2.66 | 0.32 | 63.50 | 9.08 | 1.92 |

| GUEST SUPPLY - IN-USE NOW | | | | | | | | | | | | | | | | | | |
|---|---|---|---|---|---|---|---|---|---|---|---|---|---|---|---|---|---|---|
| Initial Sample | | | | | After one (1) wash/dry cycle | | | | | | | | | | | | | |
| Weights (grams) & Measurements (inches) | | | | | Dimensions in inches | | | | | | | | | | Weight in Grams | | |
| SKU | Weight (grams) | Warp | Weft | Dobby | Warp (inches) | Actual Change | % Change | Weft (inches) | Actual Change | % Change | Dobby (inches) | Actual Change | % Change | Dobby Indent | Weight (grams) | Actual Change | % Change |
| 0904452-00 | 616.88 | 56.38 | 28.38 | 27.25 | Control Item (not tested) | | | | | | | | | | | | |
| 0904452-01 | 616.88 | 56.63 | 28.19 | 27.38 | Item 01 used in destructive analysis | | | | | | | | | | | | |
| 0904452-02 | 625.95 | 56.63 | 28.00 | 27.19 | 52.13 | 4.50 | 7.95 | 27.50 | 0.50 | 1.79 | 26.25 | 1.25 | 4.60 | 0.63 | 607.81 | 18.14 | 2.90 |
| 0904452-03 | 625.95 | 56.25 | 28.06 | 27.19 | 52.25 | 4.00 | 7.11 | 27.81 | 0.25 | 0.89 | 26.25 | 1.56 | 5.74 | 0.78 | 607.81 | 18.14 | 2.90 |
| 0904452-04 | 644.10 | 56.63 | 25.00 | 27.00 | 52.88 | 3.75 | 6.62 | 28.08 | -0.06 | -0.21 | 26.00 | 2.56 | 7.63 | 1.03 | 616.88 | 27.22 | 4.23 |
| 0904452-05 | 635.03 | 56.25 | 28.63 | 27.69 | 52.94 | 3.31 | 5.88 | 27.63 | 1.00 | 3.49 | 26.44 | 1.19 | 4.30 | 0.59 | 625.95 | 9.08 | 1.43 |
| 0904452-06 | 625.95 | 56.31 | 28.36 | 27.38 | 52.19 | 4.12 | 7.32 | 27.83 | 0.75 | 2.64 | 26.31 | 1.32 | 4.82 | 0.68 | 616.88 | 9.07 | 1.45 |
| 0904452-07 | 626.89 | 55.25 | 27.88 | 27.31 | 52.54 | 3.31 | 5.88 | 27.44 | 0.44 | 1.58 | 26.06 | 1.38 | 5.05 | 0.69 | 607.81 | 19.07 | 3.04 |
| 0904452-08 | 644.10 | 56.13 | 28.25 | 27.50 | 52.56 | 3.57 | 6.36 | 27.50 | 0.75 | 2.65 | 26.25 | 1.25 | 4.55 | 0.63 | 625.95 | 18.15 | 2.82 |
| AVERAGE | 629.06 | 56.38 | 28.20 | 27.32 | 52.56 | 3.79 | 6.73 | 27.65 | 0.52 | 1.83 | 26.22 | 1.28 | 4.69 | 0.72 | 616.98 | 16.96 | 2.88 |
| LOW | 616.88 | 56.13 | 27.88 | 27.19 | 52.13 | 3.31 | 5.88 | 27.44 | 0.25 | -0.21 | 26.00 | 1.19 | 4.30 | 0.47 | 607.81 | 9.07 | 1.43 |
| HIGH | 644.10 | 56.63 | 28.63 | 27.69 | 52.94 | 4.50 | 7.95 | 28.08 | 1.00 | 3.49 | 26.44 | 2.56 | 7.63 | 1.03 | 626.95 | 27.22 | 4.23 |
| RANGE | 27.22 | 0.50 | 0.75 | 0.5 | 0.81 | 1.19 | 2.07 | 0.63 | 1.06 | 3.70 | 0.44 | 0.97 | 3.33 | 0.16 | 18.14 | 18.15 | 2.80 |

TEST DETERMINATIONS AFTER TENTH WASH/DRY CYCLE

At the end of the tenth wash/dry cycle, the items were measured and weighed in the same manner as before processing and at the end of the first wash/dry cycle (Please reference Table – 6 at the end of this section). The measurements were again subtracted from the initial measurements and averaged. The changes in measurement are shown on the tables both as a numerical value and as a percentage.

Length

Negative values indicate a relaxing of the fiber weave, which is not uncommon. ASTM allowable length shrinkage is 10% for Terry Bath Towels.

Bath Towels – Table – 6:
0904449 - Change ranged from 4.49% to 5.39%, Average 5.07%
0904451 – Change ranged from 5.10% to 6.05%, Average 5.60%
0904452 – Change ranged from 6.57% to 7.84%, Average 7.19%

All goods are within tolerance.

Width

Negative values indicate a relaxing of the fiber weave, which is not uncommon. ASTM allowable width shrinkage is 4% for Terry Bath Towels.

Bath Towels – Table – 6:
0904449 - Change ranged from 0.91% to 3.19%, Average 2.06%
0904451 – Change ranged from –0.71% to 0.44%, Average –0.20%
0904452 – Change ranged from 1.11% to 3.74%, Average 2.25%

All goods are within tolerance.

Dobby

ASTM allowable value for Bow and Skewness is 6%. For a 27" wide towel this equates to 1.67 inches.

Bath Towels – Table - 6:
0904449 - Change ranged from 0.88" to 1.75", Average 1.28"
0904451 – Change ranged from 0.18" to 0.75", Average 0.50"
0904452 – Change ranged from 1.25" to 1.69", Average 1.37"

All goods average within tolerance. Items 0904449-04 and 0904452- 02, 04, and 06 have exceeded the 6% allowance

Item Weight

Bath Towels – Tables - 6:
0904449 - Change ranged from 9.07g to 9.08g, Average 9.07g
0904451 – Change ranged from 8.15g to 10.00g, Average 8.94g
0904452 – Change ranged from 0g to 9.07g, Average 5.32g

Visual Evaluation

Defects are noted on Table Three, Page 11 of this report.

TABLE - 6 - DIMENSIONAL DATA AFTER TEN WASH/DRY CYCLES

| GUEST SUPPLY - NEW PATENT | | | | | | | | | | | | | | | | | | |
|---|---|---|---|---|---|---|---|---|---|---|---|---|---|---|---|---|---|---|
| Initial Sample | | | | | After ten (10) wash/dry cycles | | | | | | | | | | | | | |
| Weights (grams) & Measurements (inches) | | | | | Dimensions in inches | | | | | | | | | | Weight in Grams | | |
| SKU | Weight (grams) | Warp | Weft | Dobby | Warp (inches) | Actual Change | % Change | Weft (inches) | Actual Change | % Change | Dobby (inches) | Actual Change | % Change | Dobby Indent | Weight (grams) | Actual Change | % Change |
| 0904449-00 | 562.45 | 53.31 | 27.44 | 27.03 | Control Item (not tested) | | | | | | | | | | | | |
| 0904449-01 | 562.45 | 53.31 | 27.44 | 27.03 | Item 01 used in destructive analysis | | | | | | | | | | | | |
| 0904449-02 | 562.45 | 53.25 | 27.25 | 27.00 | 50.98 | 2.67 | 5.39 | 26.38 | 0.87 | 3.19 | 25.50 | 0.85 | 3.29 | 0.44 | 553.38 | 9.07 | 1.61 |
| 0904449-03 | 562.45 | 53.25 | 27.25 | 27.00 | 50.50 | 2.75 | 5.16 | 26.75 | 0.50 | 1.83 | 25.50 | 1.25 | 4.63 | 0.63 | 553.38 | 9.07 | 1.61 |
| 0904449-04 | 562.45 | 53.00 | 27.38 | 27.06 | 50.25 | 2.75 | 5.19 | 27.13 | 0.25 | 0.91 | 25.38 | 1.75 | 6.47 | 0.60 | 553.38 | 9.07 | 1.61 |
| 0904449-05 | 562.45 | 53.06 | 27.38 | 27.25 | 50.50 | 2.56 | 4.82 | 26.75 | 0.63 | 2.30 | 25.63 | 1.12 | 4.11 | 0.56 | 553.38 | 9.07 | 1.61 |
| 0904449-06 | 562.45 | 53.56 | 27.38 | 27.13 | 50.75 | 2.81 | 5.25 | 26.88 | 0.50 | 1.83 | 25.50 | 1.38 | 5.09 | 0.69 | 553.38 | 9.07 | 1.61 |
| 0904449-07 | 562.45 | 53.13 | 27.25 | 27.00 | 50.38 | 2.75 | 5.16 | 26.88 | 0.37 | 1.36 | 25.63 | 1.25 | 4.63 | 0.63 | 553.38 | 9.07 | 1.61 |
| 0904449-08 | 580.60 | 52.75 | 27.38 | 26.63 | 50.38 | 2.37 | 4.49 | 26.56 | 0.82 | 2.99 | 25.25 | 1.31 | 4.92 | 0.65 | 571.52 | 9.08 | 1.56 |
| AVERAGE | 564.47 | 53.18 | 27.35 | 27.01 | 50.45 | 2.69 | 5.07 | 26.75 | 0.66 | 2.04 | 25.48 | 1.26 | 4.73 | 0.54 | 555.97 | 9.07 | 1.61 |
| LOW | 562.45 | 52.75 | 27.25 | 26.63 | 50.25 | 2.37 | 4.49 | 26.38 | 0.25 | 0.91 | 25.25 | 0.88 | 3.29 | 0.63 | 553.38 | 9.07 | 1.56 |
| HIGH | 580.60 | 53.56 | 27.44 | 27.25 | 50.75 | 2.87 | 5.39 | 27.13 | 0.87 | 3.19 | 25.63 | 1.75 | 6.47 | 0.84 | 571.52 | 9.08 | 1.61 |
| RANGE | 18.15 | 0.81 | 0.19 | 0.62 | 0.50 | 0.50 | 0.90 | 0.75 | 0.62 | 2.28 | 0.38 | 0.87 | 3.21 | 0.15 | 18.14 | 0.01 | 0.05 |

| GUEST SUPPLY - OBSOLETE | | | | | | | | | | | | | | | | | | |
|---|---|---|---|---|---|---|---|---|---|---|---|---|---|---|---|---|---|---|
| Initial Sample | | | | | After ten (10) wash/dry cycles | | | | | | | | | | | | | |
| Weights (grams) & Measurements (inches) | | | | | Dimensions in inches | | | | | | | | | | Weight in Grams | | |
| SKU | Weight (grams) | Warp | Weft | Dobby | Warp (inches) | Actual Change | % Change | Weft (inches) | Actual Change | % Change | Dobby (inches) | Actual Change | % Change | Dobby Indent | Weight (grams) | Actual Change | % Change |
| 0904451-00 | 571.52 | 50.63 | 27.38 | 26.56 | Control Item (not tested) | | | | | | | | | | | | |
| 0904451-01 | 571.52 | 50.63 | 27.38 | 26.56 | Item 01 used in destructive analysis | | | | | | | | | | | | |
| 0904451-02 | 571.52 | 50.38 | 27.25 | 26.63 | 47.81 | 2.57 | 5.10 | 27.19 | 0.06 | 0.22 | 26.44 | 0.75 | 2.82 | 0.38 | 561.52 | 10.00 | 1.75 |
| 0904451-03 | 517.09 | 51.25 | 26.75 | 26.19 | 48.31 | 2.94 | 5.74 | 26.94 | -0.19 | -0.71 | 26.63 | 0.31 | 1.18 | 0.16 | 508.02 | 9.07 | 1.75 |
| 0904451-04 | 517.09 | 51.13 | 26.88 | 26.38 | 48.19 | 2.94 | 5.75 | 26.06 | 0.00 | 0.00 | 26.13 | 0.75 | 2.84 | 0.26 | 508.02 | 9.07 | 1.75 |
| 0904451-05 | 535.24 | 50.56 | 27.13 | 26.56 | 47.50 | 3.06 | 6.05 | 27.06 | 0.07 | 0.26 | 26.44 | 0.62 | 2.33 | 0.31 | 526.16 | 9.09 | 1.70 |
| 0904451-06 | 535.24 | 50.50 | 27.00 | 26.50 | 47.75 | 2.75 | 5.45 | 26.88 | 0.12 | 0.44 | 26.25 | 0.63 | 2.38 | 0.32 | 527.09 | 8.15 | 1.52 |
| 0904451-07 | 535.24 | 50.44 | 27.00 | 26.63 | 47.81 | 2.63 | 5.21 | 27.25 | -0.25 | -0.93 | 26.50 | 0.75 | 2.82 | 0.38 | 527.09 | 8.15 | 1.52 |
| 0904451-08 | 517.09 | 51.13 | 26.88 | 26.25 | 48.13 | 3.00 | 5.87 | 27.06 | -0.18 | -0.67 | 26.88 | 0.18 | 0.69 | 0.09 | 508.02 | 9.07 | 1.75 |
| AVERAGE | 541.28 | 50.74 | 27.07 | 26.45 | 47.93 | 2.84 | 5.60 | 27.04 | -0.05 | -0.20 | 26.47 | 0.60 | 1.88 | 0.29 | 523.70 | 8.94 | 1.69 |
| LOW | 517.09 | 50.38 | 26.75 | 26.19 | 47.6 | 2.57 | 5.10 | 26.88 | -0.25 | -0.71 | 26.13 | 0.18 | 0.69 | -0.32 | 508.02 | 8.15 | 1.52 |
| HIGH | 571.52 | 51.25 | 27.38 | 26.63 | 48.31 | 3.06 | 6.05 | 27.25 | 0.12 | 0.44 | 26.88 | 0.75 | 2.84 | 0.22 | 561.52 | 10.00 | 1.75 |
| RANGE | 54.43 | 0.87 | 0.63 | 0.44 | 0.81 | 0.49 | 0.96 | 0.37 | 0.37 | 1.15 | 0.76 | 0.57 | 2.15 | 0.54 | 53.50 | 1.85 | 0.23 |

| GUEST SUPPLY - IN-USE NOW | | | | | | | | | | | | | | | | | | |
|---|---|---|---|---|---|---|---|---|---|---|---|---|---|---|---|---|---|---|
| Initial Sample | | | | | After ten (10) wash/dry cycles | | | | | | | | | | | | | |
| Weights (grams) & Measurements (inches) | | | | | Dimensions in inches | | | | | | | | | | Weight in Grams | | |
| SKU | Weight (grams) | Warp | Weft | Dobby | Warp (inches) | Actual Change | % Change | Weft (inches) | Actual Change | % Change | Dobby (inches) | Actual Change | % Change | Dobby Indent | Weight (grams) | Actual Change | % Change |
| 0904452-00 | 616.88 | 56.38 | 26.38 | 27.25 | Control Item (not tested) | | | | | | | | | | | | |
| 0904452-01 | 616.88 | 56.63 | 26.19 | 27.38 | Item 01 used in destructive analysis | | | | | | | | | | | | |
| 0904452-02 | 625.95 | 56.63 | 26.00 | 27.19 | 52.25 | 4.38 | 7.73 | 27.56 | 0.44 | 1.57 | 26.88 | 1.88 | 6.10 | 0.84 | 616.80 | 9.07 | 1.45 |
| 0904452-03 | 625.95 | 56.25 | 26.06 | 27.19 | 52.19 | 4.06 | 7.22 | 27.44 | 0.62 | 2.21 | 25.81 | 1.63 | 5.99 | 0.82 | 616.80 | 9.07 | 1.45 |
| 0904452-04 | 644.10 | 56.63 | 26.00 | 27.00 | 52.19 | 4.44 | 7.84 | 27.69 | 0.31 | 1.11 | 26.00 | 1.69 | 6.26 | 0.65 | 635.03 | 9.07 | 1.41 |
| 0904452-05 | 635.03 | 56.25 | 26.63 | 27.69 | 52.50 | 3.75 | 6.67 | 27.56 | 1.07 | 3.74 | 26.00 | 1.50 | 5.63 | 0.78 | 635.03 | 0.00 | 0.00 |
| 0904452-06 | 625.95 | 56.31 | 26.38 | 27.38 | 52.38 | 3.63 | 6.98 | 27.88 | 0.50 | 1.76 | 26.13 | 1.75 | 6.30 | 0.68 | 625.95 | 0.00 | 0.00 |
| 0904452-07 | 625.88 | 56.25 | 27.88 | 27.31 | 52.13 | 4.12 | 7.32 | 27.25 | 0.93 | 2.26 | 26.06 | 1.25 | 4.58 | 0.93 | 625.95 | 0.95 | 0.15 |
| 0904452-08 | 644.10 | 56.13 | 28.25 | 27.50 | 52.44 | 3.69 | 6.57 | 27.38 | 0.87 | 3.08 | 26.00 | 1.38 | 5.02 | 0.69 | 635.03 | 9.07 | 1.41 |
| AVERAGE | 629.08 | 56.38 | 26.20 | 27.32 | 52.30 | 4.06 | 7.19 | 27.54 | 0.63 | 2.25 | 26.37 | 1.37 | 5.01 | 0.78 | 627.25 | 6.32 | 0.84 |
| LOW | 616.88 | 56.13 | 27.88 | 27.00 | 52.13 | 3.69 | 6.57 | 27.25 | 0.31 | 1.11 | 25.81 | 1.26 | 4.58 | 0.50 | 616.80 | 0.00 | -1.47 |
| HIGH | 644.10 | 56.63 | 28.63 | 27.69 | 52.50 | 4.44 | 7.84 | 27.88 | 1.07 | 3.74 | 26.13 | 1.69 | 6.39 | 0.86 | 635.03 | 9.07 | 1.45 |
| RANGE | 27.22 | 0.50 | 0.75 | 0.69 | 0.37 | 0.76 | 1.27 | 0.63 | 0.76 | 2.63 | 0.32 | 0.44 | 1.81 | 0.36 | 18.16 | 9.07 | 2.92 |

TEST DETERMINATIONS AFTER THE TWENTY-FIFTH WASH/DRY CYCLE

At the end of the twenty-fifth wash/dry cycle, the items were measured and weighed in the same manner as before processing and at the end of the first and tenth wash/dry cycles (Please reference Table - 7 at the end of this section). The measurements were again subtracted from the initial measurements and averaged. The changes in measurement are again shown both as numerical values and as percentages.

Length

Negative values indicate a relaxing of the fiber weave, which is not uncommon. ASTM allowable length shrinkage is 10% for Terry Bath Towels.

Bath Towels – Table – 7:
0904449 - Change ranged from 4.85% to 5.62%, Average 5.30%
0904451 – Change ranged from 5.68% to 7.10%, Average 6.50%
0904452 – Change ranged from 7.32% to 8.95%, Average 8.21%

All goods are within tolerance.

Width

Negative values indicate a relaxing of the fiber weave, which is not uncommon. ASTM allowable width shrinkage is 4% for Terry Bath Towels.

Bath Towels – Table – 7:
0904449 - Change ranged from 0.91% to 3.21%, Average 2.13%
0904451 – Change ranged from 0.00% to 1.15%, Average 0.47%
0904452 – Change ranged from 2.68% to 4.82%, Average 3.48%

All goods average within tolerance. Item 0904452-05 has exceeded the 4% allowable variance.

Dobby

ASTM allowable value for Bow and Skewness is 6%. For a 27" wide towel this equates to 1.67 inches.

Bath Towels – Table - 7:
0904449 - Change ranged from 1.25" to 1.75", Average 1.45"
0904451 – Change ranged from 0.12" to 1.00", Average 0.53"
0904452 – Change ranged from 1.37" to 1.75", Average 1.35"

All goods average within tolerance. Items 0904449-04 and 0904452-06 have exceeded the 6% allowable variance.

Item Weight

Bath Towels – Table - 7:
0904449 - Change ranged from 9.07g to 10.93g, Average 8.52g
0904451 – Change ranged from 8.14g to 9.08g, Average 8.68g
0904452 – Change ranged from 0.00g to 9.07g, Average 4.02g

Visual Evaluation

Defects are noted on Table Three, Page 11, of this report.

Reflectance

Very little change is visually noticeable from the initial testing. All products remain within 1.08 points of the initial reading. Please reference Table Two.

Tensile Strength

The fabric tensile strengths on all items (please reference Table One) still well exceeded the required 40 lbf in the warp and 30 lbf in the fill direction.

TABLE - 7 - DIMENSIONAL DATA AFTER TWENTY-FIVE WASH/DRY CYCLES

| GUEST SUPPLY - NEW PATENT | | | | | | | | | | | | | | | | | |
|---|---|---|---|---|---|---|---|---|---|---|---|---|---|---|---|---|---|
| Initial Sample | | | | | After twenty-five (25) wash/dry cycles | | | | | | | | | | | | |
| Weights (grams) & Measurements (inches) | | | | | Dimensions in inches | | | | | | | | | | Weight in Grams | | |
| SKU | Weight (grams) | Warp | Weft | Dobby | Warp (inches) | Actual Change | % Change | Weft (inches) | Actual Change | % Change | Dobby (inches) | Actual Change | % Change | Dobby Indent | Weight (grams) | Actual Change | % Change |
| 0904449-00 | 562.45 | 53.31 | 27.44 | 27.03 | Control Item (not tested) | | | | | | | | | | | | |
| 0904449-01 | 562.45 | 53.31 | 27.44 | 27.03 | Item 01 used in destructive analysis | | | | | | | | | | | | |
| 0904449-02 | 562.45 | 53.25 | 27.25 | 27.00 | 50.26 | 2.99 | 5.62 | 26.44 | 0.81 | 2.97 | 25.19 | 1.25 | 4.63 | 0.63 | 553.38 | 9.07 | 1.61 |
| 0904449-03 | 562.45 | 53.25 | 27.25 | 27.00 | 50.63 | 2.62 | 4.92 | 26.75 | 0.50 | 1.83 | 25.38 | 1.37 | 5.07 | 0.69 | 552.45 | 10.00 | 1.78 |
| 0904449-04 | 562.45 | 53.00 | 27.38 | 27.06 | 50.13 | 2.87 | 5.42 | 27.13 | 0.25 | 0.91 | 25.39 | 1.75 | 6.47 | 0.69 | 553.38 | 9.07 | 1.61 |
| 0904449-05 | 562.45 | 53.06 | 27.36 | 27.25 | 50.13 | 2.93 | 5.52 | 26.69 | 0.69 | 2.52 | 25.31 | 1.38 | 5.06 | 0.69 | 553.38 | 9.07 | 1.61 |
| 0904449-06 | 562.45 | 53.56 | 27.18 | 27.13 | 50.75 | 2.81 | 5.25 | 26.81 | 0.57 | 2.08 | 25.50 | 1.31 | 4.83 | 0.85 | 552.45 | 10.00 | 1.70 |
| 0904449-07 | 562.45 | 53.13 | 27.25 | 27.00 | 50.19 | 2.94 | 5.50 | 26.88 | 0.37 | 1.36 | 25.31 | 1.57 | 5.81 | 0.79 | 551.52 | 10.93 | 1.94 |
| 0904449-08 | 560.60 | 52.75 | 27.38 | 26.63 | 50.19 | 2.56 | 4.85 | 26.50 | 0.88 | 3.21 | 25.00 | 1.50 | 5.63 | 0.75 | 570.60 | 10.00 | 1.72 |
| AVERAGE | 564.47 | 53.16 | 27.35 | 27.01 | 50.33 | 2.82 | 5.30 | 26.74 | 0.58 | 2.13 | 25.30 | 1.45 | 5.36 | 0.72 | 555.31 | 8.52 | 1.72 |
| LOW | 562.45 | 52.75 | 27.25 | 26.63 | 50.13 | 2.56 | 4.85 | 26.44 | 0.25 | 0.91 | 25.00 | 1.25 | 4.63 | 0.61 | 553.38 | 9.07 | 1.61 |
| HIGH | 560.60 | 53.56 | 27.44 | 27.25 | 50.75 | 2.99 | 5.62 | 26.88 | 0.88 | 3.21 | 25.50 | 1.75 | 6.47 | 0.97 | 570.60 | 10.93 | 1.94 |
| RANGE | 18.15 | 0.81 | 0.19 | 0.62 | 0.62 | 0.43 | 0.77 | 0.44 | 0.63 | 2.30 | 0.50 | 0.50 | 1.84 | 0.16 | 27.22 | 1.86 | 0.33 |

| GUEST SUPPLY - 1954 STD | | | | | | | | | | | | | | | | | |
|---|---|---|---|---|---|---|---|---|---|---|---|---|---|---|---|---|---|
| Initial Sample | | | | | After twenty-five (25) wash/dry cycle | | | | | | | | | | | | |
| Weights (grams) & Measurements (inches) | | | | | Dimensions in inches | | | | | | | | | | Weight in Grams | | |
| SKU | Weight (grams) | Warp | Weft | Dobby | Warp (inches) | Actual Change | % Change | Weft (inches) | Actual Change | % Change | Dobby (inches) | Actual Change | % Change | Dobby Indent | Weight (grams) | Actual Change | % Change |
| 0904451-00 | | | | | Control Item (not tested) | | | | | | | | | | | | |
| 0904451-01 | 571.52 | 50.63 | 27.38 | 26.56 | Item 01 used in destructive analysis | | | | | | | | | | | | |
| 0904451-02 | 571.52 | 50.38 | 27.25 | 26.63 | 47.38 | 3.00 | 5.96 | 27.19 | 0.06 | 0.22 | 26.38 | 0.81 | 3.04 | 0.41 | 562.45 | 9.07 | 1.59 |
| 0904451-03 | 517.09 | 51.25 | 26.75 | 26.19 | 47.75 | 3.50 | 6.83 | 26.75 | 0.00 | 0.00 | 25.75 | 1.00 | 3.82 | 0.56 | 508.95 | 8.14 | 1.57 |
| 0904451-04 | 517.09 | 51.13 | 26.88 | 26.38 | 47.63 | 3.50 | 6.85 | 26.75 | 0.13 | 0.48 | 26.00 | 0.75 | 2.84 | 0.38 | 508.02 | 9.07 | 1.75 |
| 0904451-05 | 535.24 | 50.56 | 27.13 | 26.55 | 47.13 | 3.43 | 6.76 | 27.00 | 0.13 | 0.48 | 26.38 | 0.62 | 2.33 | 0.31 | 526.16 | 9.08 | 1.70 |
| 0904451-06 | 535.24 | 50.50 | 27.00 | 26.69 | 47.63 | 2.87 | 5.66 | 26.69 | 0.31 | 1.15 | 26.38 | 0.31 | 1.16 | 0.16 | 527.09 | 8.15 | 1.52 |
| 0904451-07 | 535.24 | 50.44 | 27.00 | 26.62 | 47.25 | 3.19 | 6.32 | 27.00 | 0.00 | 0.00 | 26.88 | 0.12 | 0.45 | 0.06 | 527.09 | 8.15 | 1.52 |
| 0904451-08 | 517.09 | 51.13 | 26.88 | 26.25 | 47.50 | 3.63 | 7.10 | 26.63 | 0.25 | 0.93 | 26.00 | 0.63 | 2.40 | 0.32 | 508.02 | 9.07 | 1.79 |
| AVERAGE | 477.78 | 45.11 | 24.03 | 23.54 | 47.47 | 3.30 | 6.50 | 26.86 | 0.13 | 0.47 | 26.25 | 0.53 | 2.01 | 0.30 | 523.97 | 8.68 | 1.63 |
| LOW | 517.09 | 50.38 | 26.75 | 26.19 | 47.13 | 2.87 | 5.66 | 26.63 | 0.00 | 0.00 | 25.75 | 0.12 | 0.45 | 0.13 | 508.02 | 8.14 | 1.52 |
| HIGH | 571.52 | 51.25 | 27.38 | 26.69 | 47.75 | 3.63 | 7.10 | 27.19 | 0.31 | 1.15 | 26.88 | 1.00 | 3.82 | 0.22 | 562.45 | 9.08 | 1.75 |
| RANGE | 54.43 | 0.87 | 0.63 | 0.50 | 0.62 | 0.76 | 1.42 | 0.56 | 0.31 | 1.15 | 1.13 | 0.88 | 3.37 | 0.36 | 54.43 | 0.94 | 0.23 |

| GUEST SUPPLY - IN-USE NOW | | | | | | | | | | | | | | | | | |
|---|---|---|---|---|---|---|---|---|---|---|---|---|---|---|---|---|---|
| Initial Sample | | | | | After twenty-five (25) wash/dry cycles | | | | | | | | | | | | |
| Weights (grams) & Measurements (inches) | | | | | Dimensions in inches | | | | | | | | | | Weight in Grams | | |
| SKU | Weight (grams) | Warp | Weft | Dobby | Warp (inches) | Actual Change | % Change | Weft (inches) | Actual Change | % Change | Dobby (inches) | Actual Change | % Change | Dobby Indent | Weight (grams) | Actual Change | % Change |
| 0904452-00 | 616.88 | 56.38 | 28.38 | 27.25 | Control Item (not tested) | | | | | | | | | | | | |
| 0904452-01 | 615.88 | 56.63 | 28.19 | 27.38 | Item 01 used in destructive analysis | | | | | | | | | | | | |
| 0904452-02 | 625.95 | 56.63 | 28.00 | 27.19 | 51.63 | 5.00 | 8.83 | 27.00 | 1.00 | 3.57 | 25.63 | 1.37 | 5.04 | 0.69 | 616.88 | 9.07 | 1.45 |
| 0904452-03 | 625.95 | 56.25 | 28.06 | 27.19 | 51.75 | 4.50 | 8.00 | 27.13 | 0.93 | 3.31 | 25.69 | 1.44 | 5.30 | 0.72 | 625.95 | 0.00 | 0.00 |
| 0904452-04 | 644.10 | 56.63 | 28.00 | 27.00 | 51.88 | 5.07 | 8.95 | 27.25 | 0.75 | 2.68 | 25.63 | 1.62 | 6.00 | 0.81 | 644.10 | 0.00 | 0.00 |
| 0904452-05 | 635.03 | 56.25 | 28.63 | 27.69 | 52.13 | 4.12 | 7.32 | 27.25 | 1.38 | 4.82 | 25.63 | 1.62 | 5.85 | 0.81 | 635.03 | 0.00 | 0.00 |
| 0904452-06 | 625.95 | 56.31 | 28.38 | 27.38 | 51.75 | 4.56 | 8.10 | 27.38 | 1.06 | 3.52 | 25.63 | 1.75 | 6.39 | 0.88 | 615.88 | 9.07 | 1.45 |
| 0904452-07 | 626.08 | 56.25 | 27.88 | 27.31 | 51.50 | 4.75 | 8.44 | 27.00 | 0.88 | 3.16 | 25.56 | 1.44 | 5.27 | 0.72 | 625.95 | 0.13 | 0.15 |
| 0904452-08 | 644.10 | 56.13 | 28.25 | 27.50 | 51.75 | 4.38 | 7.80 | 27.31 | 0.94 | 3.33 | 25.75 | 1.50 | 5.67 | 0.78 | 635.03 | 9.07 | 1.41 |
| AVERAGE | 629.06 | 56.38 | 28.20 | 27.32 | 51.72 | 4.63 | 8.21 | 27.19 | 0.96 | 3.48 | 25.66 | 1.35 | 4.94 | 0.77 | 626.55 | 4.62 | 0.64 |
| LOW | 616.88 | 56.13 | 27.88 | 27.00 | 51.50 | 4.12 | 7.32 | 27.00 | 0.75 | 2.68 | 25.56 | 1.37 | 5.04 | 0.69 | 616.88 | 0.00 | -1.47 |
| HIGH | 644.10 | 56.63 | 28.63 | 27.69 | 52.13 | 5.07 | 8.95 | 27.38 | 1.38 | 4.82 | 25.75 | 1.75 | 6.39 | 1.03 | 644.10 | 9.07 | 1.45 |
| RANGE | 27.22 | 0.50 | 0.75 | 0.69 | 0.63 | 0.95 | 1.63 | 0.38 | 0.63 | 2.14 | 0.19 | 0.38 | 1.35 | 0.34 | 27.22 | 9.07 | 2.92 |

TEST DETERMINATIONS AFTER FIFTY WASH/DRY CYCLES

At the end of the fiftieth wash/dry cycle, the items were again weighed and measured just as they had been at the beginning of the testing and at each previous testing period. The measurements were again subtracted and averaged. New changes are again shown both numerically and as percentages (Please reference Table - 8 at the end of this section).

Length

Negative values indicate a relaxing of the fiber weave, which is not uncommon. ASTM allowable length shrinkage is 10% for Terry Bath Towels.

Bath Towels – Table – 8:
0904449 - Change ranged from 5.33% to 6.13%, Average 5.73%
0904451 – Change ranged from 6.67% to 7.42%, Average 7.07%
0904452 – Change ranged from 8.11% to 9.71%, Average 8.82%

All goods are within tolerance.

Width

Negative values indicate a relaxing of the fiber weave, which is not uncommon. ASTM allowable width shrinkage is 4% for Terry Bath Towels.

Bath Towels – Table – 8:
0904449 - Change ranged from 1.83% to 3.65%, Average 2.40%
0904451 – Change ranged from –0.71% to 0.93%, Average 0.20%
0904452 – Change ranged from 2.94% to 5.24%, Average 4.05%

All 0904449 and 0904451 are within tolerance. Item, 0904452-05, 06, 08 have exceeded the 4% allowable variance.

Dobby

ASTM allowable value for Bow and Skewness is 6%. For a 27" wide towel this equates to 1.67 inches.

Bath Towels – Table - 8:
0904449 - Change ranged from 1.62" to 1.94", Average 1.76" (five of six items fail)
0904451-Change ranged from 0.31" to 1.19", Average 0.80" (all six items pass)
0904452 – Change ranged from 1.75" to 1.88", Average 1.80" (all six items fail)

Item Weight

Bath Towels – Table - 8:
0904449 - Change ranged from 9.07g to 10.93g, Average 8.57g
0904451 – Change ranged from 9.07g to 9.10g, Average 9.08g
0904452 -- Change ranged from 5.14g to 9.07g, Average 7.56g

Visual Evaluation

Defects are noted on Table Three, Page 11 of this report.

Tensile Strength – Fabric

The fabric tensile strengths on all items (please reference Table One) still well exceeded the required 40 lbf in the warp and 30 lbf in the fill direction.

Reflectance

Very little change is visually noticeable from the initial testing. All products remain within 1.05 points of the initial reading. Please reference Table Two.

All products held their whiteness very well throughout the test period.

TABLE - 8 - DIMENSIONAL DATA AFTER FIFTY WASH/DRY CYCLES

GUEST SUPPLY - NEW PATENT

| Initial Sample | | | | | After fifty (50) wash/dry cycle | | | | | | | | | | | | |
|---|---|---|---|---|---|---|---|---|---|---|---|---|---|---|---|---|---|
| Weights (grams) & Measurements (inches) | | | | | Dimensions in Inches | | | | | | | | | | Weight in Grams | | |
| SKU | Weight (grams) | Warp | Weft | Dobby | Warp (inches) | Actual Change | % Change | Weft (inches) | Actual Change | % Change | Dobby (inches) | Actual Change | % Change | Dobby Indent | Weight (grams) | Actual Change | % Change |
| 0904449-00 | 562.45 | 53.31 | 27.44 | 27.03 | Control Item (not tested) | | | | | | | | | | | | |
| 0904449-01 | 562.45 | 53.31 | 27.44 | 27.03 | Item 01 used in destructive analysis | | | | | | | | | | | | |
| 0904449-02 | 562.45 | 53.25 | 27.25 | 27.00 | Item 02 used in destructive analysis | | | | | | | | | | | | |
| 0904449-03 | 562.45 | 53.25 | 27.25 | 27.00 | 50.25 | 3.00 | 5.63 | 26.63 | 0.62 | 2.28 | 24.94 | 1.69 | 6.26 | 0.84 | 552.45 | 10.00 | 1.78 |
| 0904449-04 | 562.45 | 53.00 | 27.38 | 27.06 | 49.75 | 3.25 | 6.13 | 26.88 | 0.50 | 1.83 | 24.94 | 1.94 | 7.17 | 0.97 | 552.45 | 10.00 | 1.78 |
| 0904449-05 | 562.45 | 53.06 | 27.38 | 27.25 | 50.06 | 3.00 | 5.65 | 26.69 | 0.69 | 2.52 | 24.88 | 1.81 | 6.64 | 0.91 | 553.38 | 9.07 | 1.61 |
| 0904449-06 | 562.45 | 53.56 | 27.32 | 27.13 | 50.50 | 3.06 | 5.71 | 26.75 | 0.63 | 2.30 | 25.00 | 1.75 | 6.45 | 0.88 | 552.45 | 10.00 | 1.78 |
| 0904449-07 | 562.45 | 53.13 | 27.25 | 27.00 | 50.00 | 3.13 | 5.89 | 26.75 | 0.50 | 1.83 | 25.13 | 1.62 | 6.00 | 0.81 | 552.45 | 10.00 | 1.78 |
| 0904449-08 | 560.60 | 52.75 | 27.34 | 26.63 | 49.94 | 2.81 | 5.33 | 26.38 | 1.00 | 3.65 | 24.63 | 1.75 | 6.57 | 0.88 | 550.67 | 10.93 | 1.98 |
| AVERAGE | 564.47 | 53.18 | 27.35 | 27.01 | 50.08 | 3.04 | 5.73 | 26.68 | 0.69 | 2.49 | 24.92 | 1.76 | 6.52 | 0.88 | 550.40 | 9.67 | 1.77 |
| LOW | 562.45 | 52.75 | 27.25 | 26.63 | 49.75 | 2.81 | 5.33 | 26.38 | 0.50 | 1.83 | 24.63 | 1.62 | 6.00 | 0.94 | 553.38 | 9.07 | 1.61 |
| HIGH | 560.60 | 53.56 | 27.44 | 27.25 | 50.69 | 3.25 | 6.13 | 26.88 | 1.00 | 3.65 | 25.13 | 1.94 | 7.17 | 1.19 | 549.67 | 10.93 | 1.98 |
| RANGE | 19.15 | 0.81 | 0.19 | 0.62 | 0.75 | 0.44 | 0.80 | 0.50 | 0.50 | 1.82 | 0.50 | 0.32 | 1.17 | 0.25 | 16.29 | 1.86 | 0.37 |

GUEST SUPPLY - (65/35) STYLE

| Initial Sample | | | | | After fifty (50) wash/dry cycle | | | | | | | | | | | | |
|---|---|---|---|---|---|---|---|---|---|---|---|---|---|---|---|---|---|
| Weights (grams) & Measurements (inches) | | | | | Dimensions in Inches | | | | | | | | | | Weight in Grams | | |
| SKU | Weight (grams) | Warp | Weft | Dobby | Warp (inches) | Actual Change | % Change | Weft (inches) | Actual Change | % Change | Dobby (inches) | Actual Change | % Change | Dobby Indent | Weight (grams) | Actual Change | % Change |
| 0904451-00 | | | | | Control Item (not tested) | | | | | | | | | | | | |
| 0904451-01 | 571.52 | 50.63 | 27.38 | 26.50 | Item 01 used in destructive analysis | | | | | | | | | | | | |
| 0904451-02 | 571.52 | 50.56 | 27.25 | 26.63 | Item 02 used in destructive analysis | | | | | | | | | | | | |
| 0904451-03 | 517.09 | 51.25 | 28.75 | 26.19 | 47.50 | 3.75 | 7.32 | 26.94 | -0.19 | -0.71 | 25.75 | 1.19 | 4.54 | 0.60 | 509.02 | 9.07 | 1.75 |
| 0904451-04 | 517.09 | 51.13 | 26.88 | 26.38 | 47.44 | 3.69 | 7.22 | 26.75 | 0.13 | 0.48 | 25.88 | 0.87 | 3.30 | 0.44 | 509.02 | 9.07 | 1.75 |
| 0904451-05 | 535.24 | 50.56 | 27.13 | 26.56 | 46.81 | 3.75 | 7.42 | 27.06 | 0.07 | 0.26 | 26.75 | 0.31 | 1.17 | 0.15 | 526.16 | 9.08 | 1.70 |
| 0904451-06 | 535.24 | 50.50 | 27.00 | 26.69 | 47.13 | 3.37 | 6.67 | 26.75 | 0.25 | 0.93 | 26.13 | 0.62 | 2.32 | 0.31 | 526.16 | 9.08 | 1.70 |
| 0904451-07 | 535.24 | 50.44 | 27.00 | 26.63 | 47.00 | 3.44 | 6.82 | 27.06 | -0.06 | -0.22 | 26.25 | 0.81 | 3.04 | 0.40 | 526.16 | 9.08 | 1.70 |
| 0904451-08 | 517.09 | 51.13 | 26.88 | 26.25 | 47.56 | 3.67 | 6.98 | 26.75 | 0.13 | 0.48 | 25.75 | 1.00 | 3.81 | 0.50 | 507.99 | 9.10 | 1.76 |
| AVERAGE | 477.78 | 48.11 | 24.03 | 23.64 | 47.24 | 3.60 | 7.07 | 26.69 | 0.05 | 0.20 | 25.09 | 0.80 | 3.03 | 0.40 | 517.09 | 9.08 | 1.73 |
| LOW | 517.09 | 50.38 | 26.75 | 26.19 | 46.81 | 3.44 | 6.67 | 26.75 | -0.19 | -0.71 | 25.75 | 0.31 | 1.17 | -0.10 | 509.02 | 9.07 | 1.75 |
| HIGH | 571.52 | 51.25 | 27.38 | 26.69 | 47.56 | 3.75 | 7.42 | 27.06 | 0.25 | 0.93 | 26.75 | 1.19 | 4.54 | 0.28 | 526.16 | 9.10 | 1.76 |
| RANGE | 54.43 | 0.87 | 0.63 | 0.50 | 0.75 | 0.31 | 0.76 | 0.31 | 0.44 | 1.64 | 1.00 | 0.88 | 3.37 | 0.38 | 18.14 | 0.03 | 0.00 |

GUEST SUPPLY - IN-USE NOW

| Initial Sample | | | | | After fifty (50) wash/dry cycles | | | | | | | | | | | | |
|---|---|---|---|---|---|---|---|---|---|---|---|---|---|---|---|---|---|
| Weights (grams) & Measurements (inches) | | | | | Dimensions in Inches | | | | | | | | | | Weight in Grams | | |
| SKU | Weight (grams) | Warp | Weft | Dobby | Warp (inches) | Actual Change | % Change | Weft (inches) | Actual Change | % Change | Dobby (inches) | Actual Change | % Change | Dobby Indent | Weight (grams) | Actual Change | % Change |
| 0904452-00 | 618.88 | 56.38 | 28.38 | 27.25 | Control Item (not tested) | | | | | | | | | | | | |
| 0904452-01 | 618.88 | 56.63 | 28.19 | 27.38 | Item 01 used in destructive analysis | | | | | | | | | | | | |
| 0904452-02 | 625.95 | 56.63 | 28.00 | 27.19 | Item 02 used in destructive analysis | | | | | | | | | | | | |
| 0904452-03 | 625.95 | 56.25 | 28.06 | 27.19 | 51.25 | 5.00 | 8.89 | 27.13 | 0.93 | 3.31 | 25.38 | 1.75 | 6.44 | 0.88 | 617.85 | 8.10 | 1.29 |
| 0904452-04 | 644.10 | 56.63 | 28.00 | 27.00 | 51.13 | 5.50 | 9.71 | 27.13 | 0.87 | 3.11 | 25.25 | 1.88 | 6.96 | 0.94 | 636.29 | 7.81 | 1.21 |
| 0904452-05 | 635.63 | 56.25 | 28.63 | 27.69 | 51.69 | 4.56 | 8.11 | 27.13 | 1.50 | 5.24 | 25.25 | 1.88 | 6.79 | 0.94 | 623.85 | 6.18 | 0.97 |
| 0904452-06 | 625.95 | 56.31 | 28.38 | 27.38 | 51.00 | 5.31 | 9.43 | 27.00 | 1.38 | 4.86 | 25.25 | 1.75 | 6.39 | 0.88 | 616.86 | 9.07 | 1.45 |
| 0904452-07 | 626.88 | 56.25 | 27.88 | 27.31 | 51.50 | 4.75 | 8.44 | 27.00 | 0.62 | 2.34 | 25.25 | 1.81 | 6.63 | 0.90 | 617.81 | 9.07 | 1.45 |
| 0904452-08 | 644.10 | 56.13 | 28.25 | 27.50 | 51.44 | 4.69 | 8.36 | 26.88 | 1.37 | 4.85 | 25.13 | 1.75 | 6.16 | 0.88 | 634.96 | 5.14 | 0.80 |
| AVERAGE | 629.08 | 56.38 | 28.20 | 27.32 | 51.34 | 4.97 | 8.82 | 27.06 | 1.16 | 4.06 | 25.25 | 1.80 | 6.60 | 0.90 | 626.11 | 7.66 | 1.20 |
| LOW | 618.88 | 56.13 | 27.88 | 27.00 | 51.00 | 4.56 | 8.11 | 26.88 | 0.62 | 2.34 | 25.13 | 1.75 | 6.36 | 0.88 | 616.86 | 5.14 | 0.80 |
| HIGH | 644.10 | 56.63 | 28.63 | 27.69 | 51.69 | 5.50 | 9.71 | 27.13 | 1.50 | 5.24 | 25.38 | 1.88 | 6.96 | 1.22 | 638.98 | 9.07 | 1.45 |
| RANGE | 27.22 | 0.50 | 0.75 | 0.69 | 0.69 | 0.94 | 1.60 | 0.25 | 0.88 | 2.90 | 0.25 | 0.13 | 0.60 | 0.34 | 22.08 | 3.93 | 0.65 |

--